US009154880B2

(12) United States Patent
Hiruma et al.

(10) Patent No.: US 9,154,880 B2
(45) Date of Patent: Oct. 6, 2015

(54) APPARATUS AND A METHOD FOR CONTROLLING A SOUND FIELD

(71) Applicant: KABUSHIKI KAISHA TOSHIBA, Minato-ku, Tokyo (JP)

(72) Inventors: Takahiro Hiruma, Tokyo (JP); Akihiko Enamito, Kanagawa-ken (JP); Osamu Nishimura, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 280 days.

(21) Appl. No.: 13/921,675

(22) Filed: Jun. 19, 2013

(65) Prior Publication Data

US 2014/0177882 A1 Jun. 26, 2014

(30) Foreign Application Priority Data

Jul. 31, 2012 (JP) ..... 2012-170635

(51) Int. Cl.
*H04R 5/02* (2006.01)
*H04R 5/04* (2006.01)
*H04S 7/00* (2006.01)

(52) U.S. Cl.
CPC *H04R 5/04* (2013.01); *H04S 7/303* (2013.01); *H04R 2400/13* (2013.01); *H04R 2430/01* (2013.01)

(58) Field of Classification Search
CPC ..... H04S 1/005; H04S 2420/01; H04S 1/007; H04S 7/30; H04S 3/004; H04S 7/304; H04S 1/002; H04S 2400/11; H04S 2400/13; H04S 2400/15; H04S 3/002; H04S 3/008; H04S 7/303; H04R 1/1091; H04R 1/403; H04R 1/406; H04R 5/027; H04R 2430/01; H04R 27/00; H04R 3/002; H04R 3/02; H04R 5/00; H04R 5/04
USPC ..... 381/97, 99, 361, 306, 300, 303, 17, 381/349, 377, 56–59
See application file for complete search history.

(56) References Cited

U.S. PATENT DOCUMENTS

| | | | | |
|---|---|---|---|---|
| 2003/0065513 | A1* | 4/2003 | Kaminuma | 704/266 |
| 2009/0129604 | A1* | 5/2009 | Enamito et al. | 381/58 |
| 2011/0051937 | A1* | 3/2011 | Ma et al. | 381/17 |
| 2011/0116638 | A1* | 5/2011 | Son et al. | 381/1 |
| 2012/0195447 | A1* | 8/2012 | Hiruma et al. | 381/306 |

FOREIGN PATENT DOCUMENTS

| | | | |
|---|---|---|---|
| JP | 2006-74442 | A | 3/2006 |
| JP | 2009-111920 | A | 5/2009 |
| JP | 2010-199802 | A | 9/2010 |

OTHER PUBLICATIONS

Japanese Office Action dated Aug. 22, 2014 from JP Application No. 2012-170635, 4 pages.

* cited by examiner

*Primary Examiner* — Lun-See Lao
(74) *Attorney, Agent, or Firm* — Amin, Turocy & Watson, LLP

(57) ABSTRACT

A first filter coefficient and a second filter coefficient are calculated by using spatial transfer characteristics from a first speaker and a second speaker to a first control point and a second control point, and a first sound increase ratio na at the first control point and a second sound increase ratio nb at the second control point, so that, when the first filter coefficient is a through characteristic, a first composite sound pressure from the first speaker and the second speaker to the first control point is na times a first sound pressure from the first speaker to the first control point, and a second composite sound pressure from the first speaker and the second speaker to the second control point is nb times a second sound pressure from the first speaker to the second control point.

6 Claims, 27 Drawing Sheets

APPARATUS AND A METHOD FOR CONTROLLING A SOUND FIELD

CROSS-REFERENCE TO RELATED APPLICATION

This application is based upon and claims the benefit of priority from Japanese Patent Application No. 2012-170635, filed on Jul. 31, 2012; the entire contents of which are incorporated herein by reference.

FIELD

Embodiments described herein relate generally to an apparatus and a method for controlling a sound field.

BACKGROUND

For example, when a plurality of listeners listens to a sound (such as a music) in one hall or indoor, a listener desires to listen to the sound with larger volume in some area while another listener desires to listens to the sound with regular volume (or smaller volume than regular volume). Briefly, the listeners have various needs based on their liking or circumstances. Here, from a loudspeaker located in front of two areas (some area and another area), a sound pressure (arrival sound pressure) is respectively transferred to the two areas. Accordingly, an apparatus and a method for controlling respective sound pressures are desired.

DETAILED DESCRIPTION

According to one embodiment, a sound field control apparatus includes a control filter, a first speaker, a second speaker, and a calculation unit. The control filter is configured to convolute a first filter coefficient and a second filter coefficient with a first acoustic signal to generate a second acoustic signal and a third acoustic signal. The first speaker radiates a sound toward a first area having a first control point and a second area having a second control point, based on the second acoustic signal. The second speaker radiates a sound toward the first area and the second area, based on the third acoustic signal. The calculation unit is configured to calculate the first filter coefficient and the second filter coefficient by using spatial transfer characteristics from the first speaker and the second speaker to the first control point and the second control point, and a first sound increase ratio na at the first control point and a second sound increase ratio nb at the second control point, so that a first composite sound pressure from the first speaker and the second speaker to the first control point is na times a first sound pressure from the first sound source speaker to the first control point when the first filter coefficient is a through characteristic, and so that a second composite sound pressure from the first speaker and the second speaker to the second control point is nb times a second sound pressure from the first speaker to the second control point when the first filter coefficient is the through characteristic.

Various embodiments will be described hereinafter with reference to the accompanying drawings.

(The First Embodiment)

As to a sound field control apparatus 100 of the first embodiment, in a sound field for listeners able to listen to the sound, a sound pressure thereof is increased, decreased or maintained, i.e., the sound field-control is performed. Here, the sound filed includes a first area and a second area. For example, the first area is an area in front of a sound source speaker, and the second area is a surrounding area of the first area. Moreover, in the first embodiment, the first area is a target area for sound increase, and a sound pressure coming from the sound source speaker is increased. The second area is a target area for sound pressure-maintenance or sound reduction, and a sound pressure coming from the sound source speaker is maintained or reduced.

Moreover, as to the first embodiment, in the first area and the second area, a sound increase ratio of the sound pressure to a reference sound pressure is freely adjusted as a parameter. As a result, effect of sound increase/sound reduction/sound pressure-maintenance can be obtained with combination.

Figure 1:
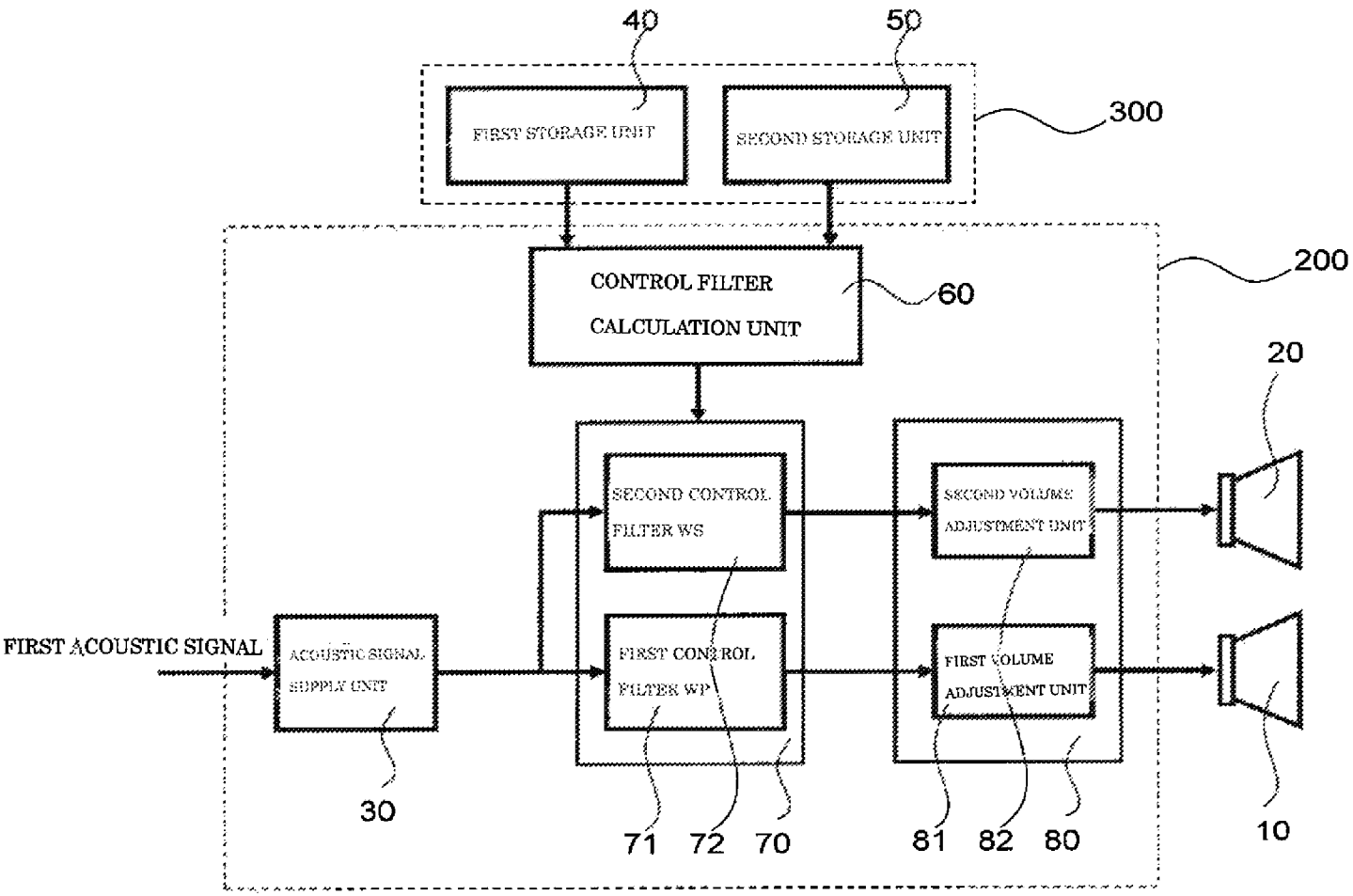
FIG. 1 is a block diagram of a sound field control apparatus according to a first embodiment.

FIG. 1 is a block diagram of the sound field control apparatus 100 according to the first embodiment.

A first sound source speaker 10 and a second sound source speaker 20 radiate sounds toward the first area and the second area, based on an acoustic signal.

An acoustic signal supply unit 30 receives a first acoustic signal (For example, a music to be played indoors) from the outside, and supplies the first acoustic signal to a control filter 70.

A first storage unit 40 stores a spatial transfer characteristic from each sound source speaker to the first area and the second area. A second storage unit 50 stores sound increase ratios na and nb. Here, na is a ratio of a sound pressure of the first area to a reference sound pressure, and nb is a ratio of a sound pressure of the second area to the reference sound pressure. The reference sound pressure is an arrival sound pressure from the first sound source speaker to the first area and the second area in status that the sound field control apparatus 100 does not perform the sound field-control (without control).

A control filter calculation unit 60 calculates a coefficient of the control filter 70 by using the spatial transfer characteristic (stored in the first storage unit 40) and the sound increase ratio na and nb (stored in the second storage unit 50).

The control filter 70 includes a first control filter (Wp) 71 and a second control filter (Ws) 72, and calculates an acoustic signal for the first sound source speaker 10 and the second sound source speaker 20 by convoluting the coefficient (an FIR operation) (calculated by the control filter calculation unit 60) with the first acoustic signal. Here, the first control filter 71 is used for the first sound source speaker 10, and the second control filter 72 is used for the second sound source speaker 20.

In case of necessity, the sound source control apparatus 100 includes a first volume adjustment unit 81 and a second volume adjustment unit 82. Briefly, a volume adjustment unit 80 to adjust a volume of sound radiated from each sound source speaker, and an input device (not shown in FIG. 1), are equipped. Here, the first volume adjustment unit 81 is used for the first sound source speaker 10, and the second volume adjustment unit 82 is used for the second sound source speaker 20.

Moreover, for example, the control filter 70 and the control filter calculation unit 60 can be realized by executing a control program with an operation processing device 200 such as a CPU or a MPU. Furthermore, as the first storage unit 40 and the second storage unit 50, a storage device 300 such as a memory or a HDD can be used. Furthermore, the first sound source speaker 10 and the second sound source speaker 20 may be stored in or attached outside the sound field control apparatus 100.

Hereinafter, component of the sound field control apparatus 100 is explained in detail.

The acoustic signal supply unit 30 supplies the first acoustic signal (as a source) to the control filter 70. As a method for the acoustic signal supply unit 30 to obtain the first acoustic signal, various variations can be applied. For example, such as a television, an audio equipment or an AV equipment, contents including an acoustic signal (For example, contents including the acoustic signal only, contents including the acoustic signal with moving images or static images, contents including another relational information therewith) (Hereinafter, they are called "contents") may be acquired by terrestrial broadcasting or satellite broadcasting. The contents may be acquired via an Internet, an Intranet, or a home network. Furthermore, contents may be acquired by reading from a storage medium such as a CD, a DVD, or a stored disk device. Furthermore, a voice inputted by a microphone may be obtained. The acoustic signal supply unit 30 supplies the first acoustic signal (obtained in this way) to the control filter 70.

Figure 2:
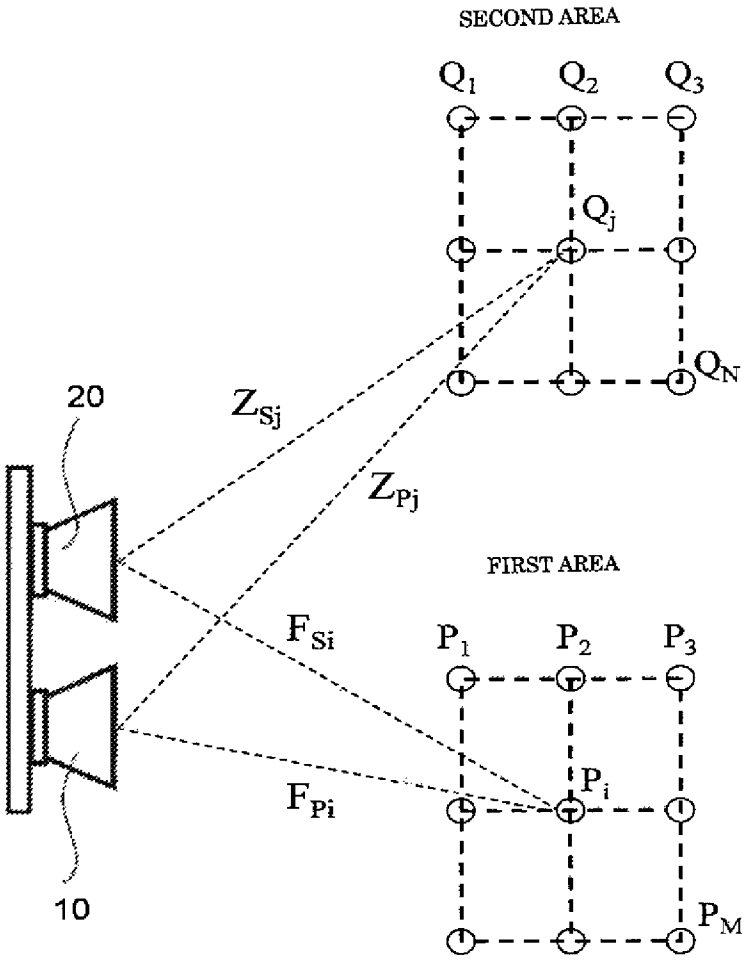
FIG. 2 is a schematic diagram to explain a first area and a second area according to the first embodiment.

The first storage unit 40 stores a spatial transfer characteristic from the first sound source speaker 10 and the second sound source speaker 20 to the first area and the second area. Here, the spatial transfer characteristic is a transfer function representing relationship between a sound pressure at a position of each speaker and a sound pressure at a position of each area, when a sound is radiated from each speaker to each area. Moreover, in the first embodiment, as shown in FIG. 2, control points i (M points) are set into the first area to control sound increase, and control points j (N points) are set into the second area to control sound pressure-maintenance. The spatial transfer characteristic (radiation impedance) from each speaker to each control point is previously stored.

Here, a radiation impedance from the first sound source speaker 10 to a control point i of the first area is represented as $F_{pi}$, a radiation impedance from the second sound source speaker 20 to the control point i of the first area is represented as $F_{si}$, a radiation impedance from the first sound source speaker 10 to a control point j of the second area is represented as $Z_{pj}$, and a radiation impedance from the second sound source speaker 20 to the control point j of the first area is represented as $Z_{sj}$.

The second storage unit 50 stores sound increase ratios na and nb. Here, na is a ratio of a sound pressure of the control point i in the first area to a reference sound pressure, and nb is a ratio of a sound pressure of the control point j in the second area to the reference sound pressure. In this case, as to all control points i in the first area, the sound increase ratio na is commonly stored. Furthermore, as to all control points j in the second area, the sound increase ratio nb is commonly stored. The sound increase ratio is "n>1" in case of sound increase, "n=1" in case of sound pressure-maintenance, and "0≤n<1" in case of sound reduction. Here, in case of the sound increase ratio n, effect thereof is represented as $+20 \log_{10}(n)$ by logarithm conversion. For example, in case of "n=2", effect of sound increase is represented as "$20 \log_{10}(2) \approx +6$ dB". In case of "n=3", effect of sound increase is represented as "$20 \log_{10}(3) \approx +9.5$ dB". In case of "n=0.5", effect of sound reduction is represented as "$20 \log_{10}(0.5) \approx -6$ dB". In case of "n=1", effect of sound maintenance is represented as "$20 \log_{10}(1) \approx \pm 0$ dB". In case of "n=0", effect of sound deadening is represented as "$20 \log_{10}(0) \approx -\infty$dB".

Moreover, as a method for the second storage unit 50 to store the sound increase ration, various variations can be applied. For example, the second storage unit 50 can store the sound increase ratio inputted by a listener using the input device 400 such as a remote controller or a cellular-phone.

Furthermore, as the sound increase ratio, the listener may input a continuous value or a discrete value. Furthermore, an upper limit of the sound increase ratio mat be set. Moreover, a lower limit of the sound increase ratio may be "1" or a predetermined value above "1".

Furthermore, for example, ON/OFF of "sound increase-control" and the sound increase ratio may be separately inputted, or the sound increase ratio may be only inputted. In the latter case, "sound increase-control" may be set to OFF in case of the sound increase ratio of the first area "na=1", or the sound increase-control may be performed as "na=1".

Furthermore, in order to simplify the input, ON/OFF button of "sound increase-control" may be prepared (In case of "ON", a predetermined value (For example, n=2 or n=3) is used). Furthermore, with ON/OFF button of "sound increase-control", one or a plurality of buttons to indicate a value selected from predetermined values (For example, one button to select n=2 or n=3, three buttons to select n=1.5, n=2 or n=3) may be prepared.

The control filter calculation unit 60 calculates a coefficient of the control filter 70 (Briefly, a coefficient Wp of the first control filter 71, a coefficient Ws of the second control filter 72) by using the sound increase ratio (obtained from the second storage unit 50) and the radiation impedance (obtained from the first storage unit 40). Moreover, the coefficient of the control filter can be calculated as a pair of (a complex number or a gain) and a phase. Here, a control filter characteristic (amplitude, phase) of the first sound source speaker with control is different from that without control. The control filter calculation unit 60 calculates the coefficient Wp of the first control filter 71 without control as a through characteristic. Moreover, the through characteristic is a characteristic to output the inputted acoustic signal as it is. Briefly, the coefficient Wp thereof is "1".

Furthermore, the control filter calculation unit 60 calculates a coefficient Wp of the first control filter 71 with control, and a coefficient Ws of the second control filter 72 with control. In this case, as a condition, in the first area, a composite sound pressure from the first sound source speaker 10 and the second sound source speaker 20 is approximated to "na" times the sound pressure (a reference sound pressure) from the first sound source speaker without control. Furthermore, as the condition, in the second area, the composite sound pressure is approximated to "nb" times the reference sound pressure. Briefly, in case of control, the coefficient Wp and the coefficient Ws are calculated so as to satisfy this condition. Here, "approximate" means, a composite sound pressure at each control point in the first area is within a range of "na±Δn1" times the reference sound pressure, and a composite sound pressure at each control point in the second area is within a range of "nb±Δn2" times the reference sound pressure. Moreover, Δn1 and Δn2 are positive real numbers, and can be previously determined in a range to obtain the effective control effect (experimentally confirmed).

Briefly, the control filter calculation unit 60 calculates the coefficient of each control filter so that the composite sound pressure is within above-mentioned range. For example, by measuring the reference sound pressure and the composite sound pressure at each control point in the first area and the second area via a microphone (not shown in FIG. 1), in the first area, the composite sound pressure from the first sound source speaker 10 and the second sound source speaker 20 is decided to be approximated to "na" times the sound pressure (a reference sound pressure) from the first sound source speaker without control. In the second area, the composite sound pressure is decided to be approximated to "nb" times the reference sound pressure.

The control filter 70 convolutes each coefficient (an FIR operation) (calculated by the control filter calculation unit 60) with the first acoustic signal (obtained from the acoustic signal supply unit 30). Specifically, by convoluting the coefficient Wp with the first acoustic signal, the first control filter 71 calculates an acoustic signal (second acoustic signal) for the first sound source speaker 10. Furthermore, by convoluting the coefficient Ws with the first acoustic signal, the second control filter 72 calculates an acoustic signal (third acoustic signal) for the second sound source speaker 20. The first control filter 71 supplies the second acoustic signal to the first sound source speaker 10. The second control filter 72 supplies the third acoustic signal to the second sound source speaker 20. Moreover, "supply" includes supply processing via a volume adjustment unit 80 (explained afterwards).

The volume adjustment unit 80 adjusts a volume of each sound source speaker. Specifically, a first volume adjustment unit 81 adjusts a volume of the first sound source speaker 10, and a second volume adjustment unit 82 adjusts a volume of the second sound source speaker 20. Briefly, the first volume adjustment unit 81 amplifies amplitude of the second acoustic signal calculated by the control filter 70. Furthermore, the second volume adjustment unit 82 amplifies amplitude of the third acoustic signal calculated by the control filter 70. Moreover, in this case, respective sound change amounts (amplified) of amplitude of the first acoustic signal and the second acoustic signal had better be equal.

Based on the second acoustic signal and the third acoustic signal (including an acoustic signal amplified by the volume adjustment unit 80) obtained from the control filter 70, the first sound source speaker 10 and the second sound source speaker 20 respectively radiate a sound toward the first area and the second area.

Hereinafter, in case that M control points are positioned in the first area and N control points are positioned in the second area, a method for deriving a filter to control sound increase by two sound source speakers is explained. Moreover, in case of control, the control filter calculation unit 60 calculates a coefficient Wp of the first control filter 71 and a coefficient Ws of the second control filter 72 so that a composite sound pressure from the first sound source speaker 10 and the second sound source speaker 20 is equal to na times a reference sound pressure in the first area, and the composite sound pressure is equal to nb times the reference sound pressure in the second area. Hereinafter, this example is explained.

After controlling a sound field, a sound pressure of each area is determined by following equations. Briefly, the sound pressure of the first area is na times a sound pressure from the first sound source speaker (P) without control, and the sound pressure of the second area is nb times a sound pressure from the first sound source speaker (P) without control.

A sound pressure (composite sound pressure) $P_i$ at i-th control point in the first area is represented as following equation.

$$P_i=F_{Pi}\cdot q_P+F_{Si}\cdot q_S=n_a\cdot F_{Pi}\cdot q \tag{1}$$

Furthermore, a sound pressure (composite sound pressure) $Q_j$ at j-th control point in the second area is represented as following equation.

$$Q_j=Z_{Pj}\cdot q_P+Z_{Sj}\cdot q_S=n_b\cdot Z_{Pj}\cdot q \tag{2}$$

Moreover, in equations (1) and (2), q is a complex amplitude of the first sound source speaker (P) without control, $q_p$ is a complex amplitude of the first sound source speaker (P) with control, and $q_s$ is a complex amplitude of the second sound source speaker (S) with control.

First, the second area is thought about. By transforming the equation (2), following equation is generated.

$$Q'_j=Z_{Pj}\cdot q_P-n_b\cdot Z_{Pj}\cdot q+Z_{Sj}\cdot q_s=0 \tag{3}$$

Here, assume that a sound pressure from the first sound source speaker (P) and the second sound source speaker (S) at a control point j among N points in the second area is $Q_j'$. Here, a sum $U_n$ of acoustic energy that the sound pressure $Q_j'$ is provided to each control point j is represented as following equation.

$$U_n = \sum_{j=1}^{N} (Q'_j \cdot Q'^*_j) \tag{4}$$

$$= \sum_{j=1}^{N} (Z_{pj} \cdot Z^*_{pj} \cdot q_p \cdot q^*_p - n_b \cdot Z_{pj} \cdot Z^*_{pj} \cdot q_p \cdot q^* + Z_{pj} \cdot Z^*_{sj} \cdot q_p \cdot q_s - q^*_s + Z_{sj} \cdot Z^*_{pj} \cdot q_s \cdot q^*_p - n_b \cdot Z_{sj} \cdot Z^*_{pj} \cdot q_s \cdot q^* + Z_{sj} \cdot Z^*_{sj} \cdot q_s \cdot q^*_s)$$

In order to satisfy the equation (2), the sum $U_n$ of acoustic energy of the equation (4) is minimized. Briefly, in the first embodiment, by minimizing the sum $U_n$ of acoustic energy, an area to guarantee the control effect is enlarged to all of the second area, and spatial robustness can be planed. Furthermore, when radiation impedance at one control point only is used for deriving the control filter, peak/dip characteristics existing on frequency components of the radiation impedance are strongly appeared on the control filter derived. As a result, the replay effect is damaged by noise due to the peak and dip. Accordingly, by positioning a plurality of control points into the second area, the peak and dip can be smoothed.

Here, $q_s$ is a complex amplitude, and represented as following equation. Moreover, in the equation (5), the first term of the right side represents a real number of the complex amplitude $q_s$ of the second sound source speaker (S) with control, and the second term of the right side represents an imaginary number of the complex amplitude $q_s$ of the second sound source speaker (S) with control.

$$q_s = q_s^r + j \cdot q_s^i \tag{5}$$

Accordingly, as shown in equations (6)~(8), by partially differentiating a real number part $q_s^r$ and an imaginary number part $q_s^i$ of the complex amplitude of the equation (5), a sound change amount is generated. By approximating the sound change amount to zero, the complex amplitude to minimize the sum $U_n$ of acoustic energy is generated.

$$\frac{\partial U_n}{\partial q_s^r} = 0, \quad \frac{\partial U_n}{\partial q_s^i} = 0 \tag{6}$$

$$\frac{\partial U_n}{\partial q_s^r} = \sum_{j=1}^{N} (Z_{pj} \cdot Z^*_{sj} \cdot q_p - n_b \cdot Z_{pj} \cdot Z^*_{sj} \cdot q + Z_{sj} \cdot Z^*_{pj} \cdot q^*_p - n_b \cdot Z_{sj} \cdot Z^*_{pj} \cdot q^* + 2 \cdot Z_{sj} \cdot Z^*_{sj} \cdot q^r_s) = 0 \tag{7}$$

$$\frac{\partial U_n}{\partial q_s^i} = \sum_{j=1}^{N} (Z_{pj} \cdot Z^*_{sj} \cdot (-j) \cdot q_p - n_b \cdot Z_{pj} \cdot Z^*_{sj} \cdot (-j) \cdot q + Z_{sj} \cdot Z^*_{pj} \cdot j \cdot q^*_p - n_b \cdot Z_{sj} \cdot Z^*_{pj} \cdot j \cdot q^* + 2 \cdot Z_{sj} \cdot Z^*_{sj} \cdot q^i_s) = 0 \tag{8}$$

From above equations, a real number part and an imaginary number part of the complex amplitude are equations (9) and (10) respectively.

$$q^r_s = -\frac{\sum_{j=1}^{N} (Z_{pj} \cdot Z^*_{sj} \cdot q_p - n_b \cdot Z_{pj} \cdot Z^*_{sj} \cdot q + Z_{sj} \cdot Z^*_{pj} \cdot q^*_p - n_b \cdot Z_{sj} \cdot Z^*_{pj} \cdot q^*)}{2 \sum_{j=1}^{N} (Z_{sj} \cdot Z^*_{sj})} \tag{9}$$

-continued $$q^i_s = -\frac{\sum_{j=1}^{N} (Z_{pj} \cdot Z^*_{sj} \cdot (-j) \cdot q_p - n_b \cdot Z_{pj} \cdot Z^*_{sj} \cdot (-j) \cdot q + Z_{sj} \cdot Z^*_{pj} \cdot j \cdot q^*_p - n_b \cdot Z_{sj} \cdot Z^*_{pj} \cdot j \cdot q^*)}{2 \sum_{j=1}^{N} (Z_{sj} \cdot Z^*_{sj})} \tag{10}$$

By substituting equations (9) and (10) for the equation (5), following equation is generated.

$$q_s = \alpha \cdot (q_p - n_b \cdot q) \tag{11}$$

$$\alpha = -\frac{\sum_{j=1}^{N} (Z_{pj} \cdot Z^*_{sj})}{\sum_{j=1}^{N} (Z_{sj} \cdot Z^*_{sj})} \tag{12}$$

Next, the first area is thought about. By transforming the equation (1), following equation is generated.

$$P_i' = F_{pi} \cdot q_p - n_a \cdot F_{pi} \cdot q + F_{si} \cdot q_s = 0 \tag{13}$$

By substituting the equation (11) for the equation (13), following equation is generated.

$$P_i' = F_{pi} \cdot q_p - n_a \cdot F_{pi} \cdot q + F_{si} \cdot \alpha \cdot (q_p - n_b \cdot q) = \beta_i \cdot q_p + \gamma_i \cdot q = 0 \tag{14}$$

$$\beta_i = F_{pi} + F_{si} \cdot \alpha \tag{15}$$

$$\gamma_i = -n_a \cdot F_{pi} - n_b \cdot F_{si} \cdot \alpha \tag{16}$$

Here, a sum $U_m$ of acoustic energy that the sound pressure $P_i'$ (from the first sound source speaker (P) and the second sound source speaker (S)) is provided to the first area is represented as following equation.

$$U_m = \sum_{i=1}^{M} (P'_i \cdot Q'^*_i)$$

$$= \sum_{i=1}^{M} (\beta_i \cdot \beta^*_i \cdot q_p \cdot q^*_p + \beta_i \cdot \gamma^*_i \cdot q_p \cdot q^* \cdot \gamma_i \cdot \beta^*_i \cdot q \cdot q^*_p + \gamma_i \cdot \gamma^*_i \cdot q \cdot q^*)$$

In order to satisfy the equation (1), the sum $U_m$ of acoustic energy of the equation (17) is minimized. Here, $q_p$ is a complex amplitude, and represented as following equation.

$$q_p = q^r_p + j \cdot q^i_p \tag{18}$$

$$\frac{\partial U_m}{\partial q^r_p} = 0, \quad \frac{\partial U_m}{\partial q^i_p} = 0 \tag{19}$$

$$\frac{\partial U_m}{\partial q^r_p} = \sum_{i=1}^{M} (2 \cdot \beta_i \cdot \beta^*_i \cdot q^r_p + \beta_i \cdot \gamma^*_i \cdot q^* + \gamma_i \cdot \beta^*_i \cdot q) = 0 \tag{20}$$

-continued $$\frac{\partial U_m}{\partial q_p^i} = \sum_{i=1}^{M}(2\cdot\beta_i\cdot\beta_i^*\cdot q_p^i + \beta_i\cdot\gamma_i^*\cdot j\cdot q^* + \gamma_i\cdot\beta_i^*\cdot(-j)\cdot q) = 0 \tag{21}$$

Accordingly, a real number part and an imaginary number part of the complex amplitude are equations (22) and (23) respectively.

$$q_p^r = -\frac{\sum_{i=1}^{M}(\beta_i\cdot\gamma_i^*\cdot q^* + \gamma_i\cdot\beta_i^*\cdot q)}{\sum_{i=1}^{M}(\beta_i\cdot\beta_i^*)} \tag{22}$$

$$q_p^i = -\frac{\sum_{i=1}^{M}(\beta_i\cdot\gamma_i^*\cdot j\cdot q^* + \gamma_i\cdot\beta_i^*\cdot(-j)\cdot q)}{\sum_{i=1}^{M}(\beta_i\cdot\beta_i^*)} \tag{23}$$

By substituting equations (22) and (23) for the equation (18), following equation is generated.

$$q_p = -\frac{\sum_{i=1}^{M}(\gamma_i\cdot\beta_i^*)}{\sum_{i=1}^{M}(\beta_i\cdot\beta_i^*)}\cdot q \tag{24}$$

From above equations, in case of satisfying equations (1) and (2), respective complex amplitudes of the first sound source speaker (P) and the second sound source speaker (S) are represented as equations (25) and (26).

$$q_p = -\frac{\sum_{i=1}^{M}(\gamma_i\cdot\beta_i^*)}{\sum_{i=1}^{M}(\beta_i\cdot\beta_i^*)}\cdot q \tag{25}$$

$$q_s = \alpha\cdot(q_p - n_b\cdot q) \tag{26}$$

In equations (25) and (26), parameters are represented as follows.

$$\alpha = -\frac{\sum_{j=1}^{N}(Z_{pj}\cdot Z_{sj}^*)}{\sum_{j=1}^{N}(Z_{sj}\cdot Z_{sj}^*)} \tag{27}$$

$$\beta_i = F_{pi} + F_{si}\cdot\alpha \tag{28}$$

$$\gamma_i = -n_a\cdot F_{pi} - n_b\cdot F_{si}\cdot\alpha \tag{29}$$

Accordingly, by subjecting the complex amplitude to inverse Fourier transform, a control filter in time area is generated. This filter is the control filter 70 in FIG. 1. Briefly, the first control filter ($Wp|_{OFF}$) without control is represented as an equation (30). Here, the complex amplitude q is reference amplitude. As a result, the equation (30) is through characteristic filter.

$$W_{P|OFF} = ifft(q) \tag{30}$$

Furthermore, the first control filter ($Wp|_{ON}$) with control, the second control filter (Ws) with control, are represented as equations (31) and (32) respectively.

$$W_{P|ON} = ifft(q_P) \tag{31}$$

$$W_S = ifft(q_S) \tag{32}$$

Figure 12A:
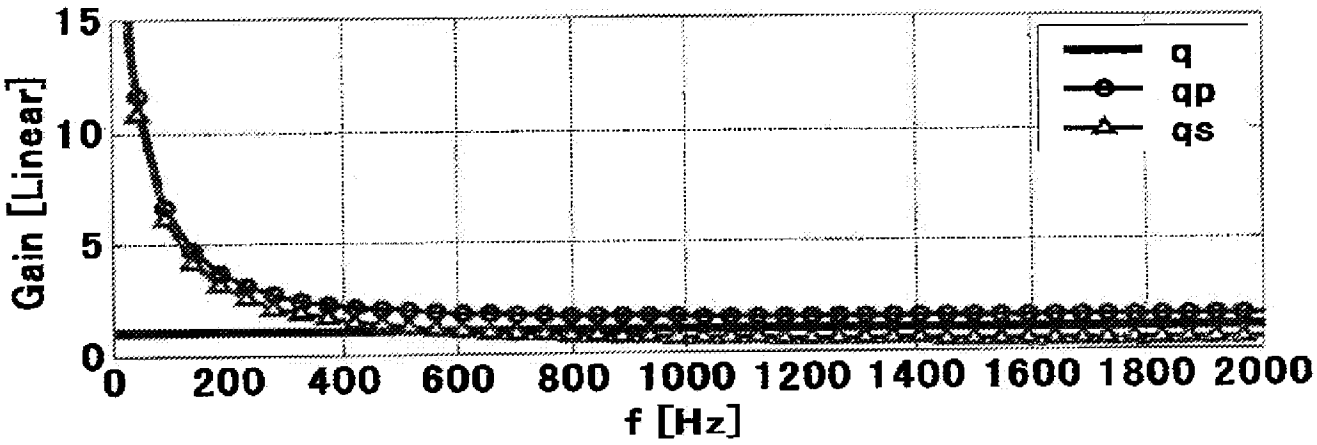
FIGS. 12A and 12B are amplitude and phase diagrams of a control filter according to the first embodiment.
Figure 12B:
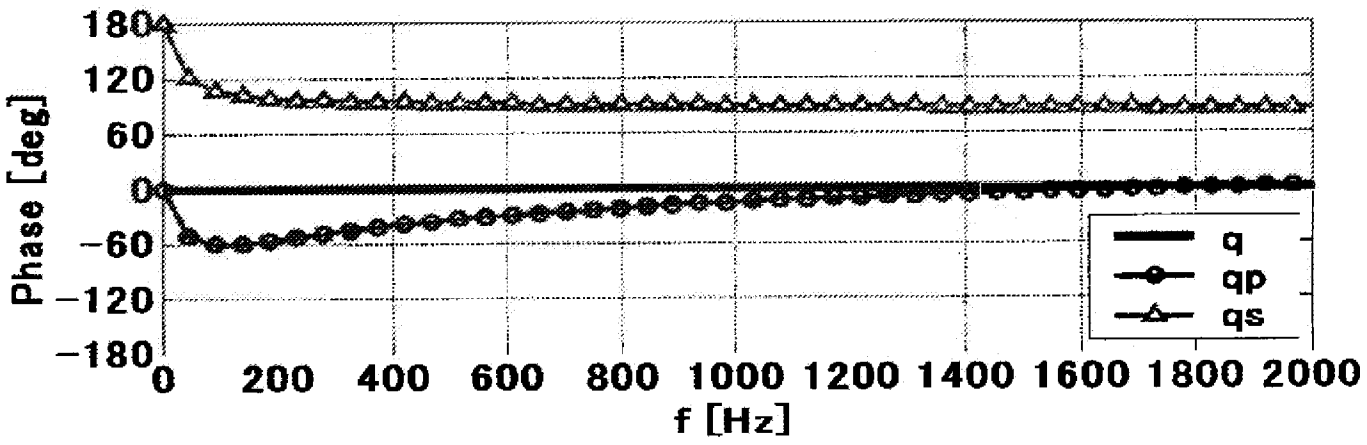

FIGS. 12A and 12B are one example of amplitude/phase diagram of the control filter 70. As to the control filter 70 of the first embodiment, as shown in FIGS. 12A and 12B, a phase relationship between a complex amplitude $q_p$ of the first sound source speaker (P) with control and a complex amplitude $q_s$ of the second sound source speaker (S) with control is approximately opposite (phase difference 180°) in a low band (For example, smaller than 400 Hz). As to superimposition of sounds at the same phase, even if a phase shift thereof occurs to some extent, low band-sounds having long wavelength are overlapped in a wide range. Accordingly, a sound field cannot be controlled in an arbitrary point or area only. In the first embodiment, by combining sound waves of which phases are approximately opposite and a phase shift due to a difference between distances from respective speakers to the control point, the sound field of low band can be controlled in the arbitrary point or area.

Figure 13:
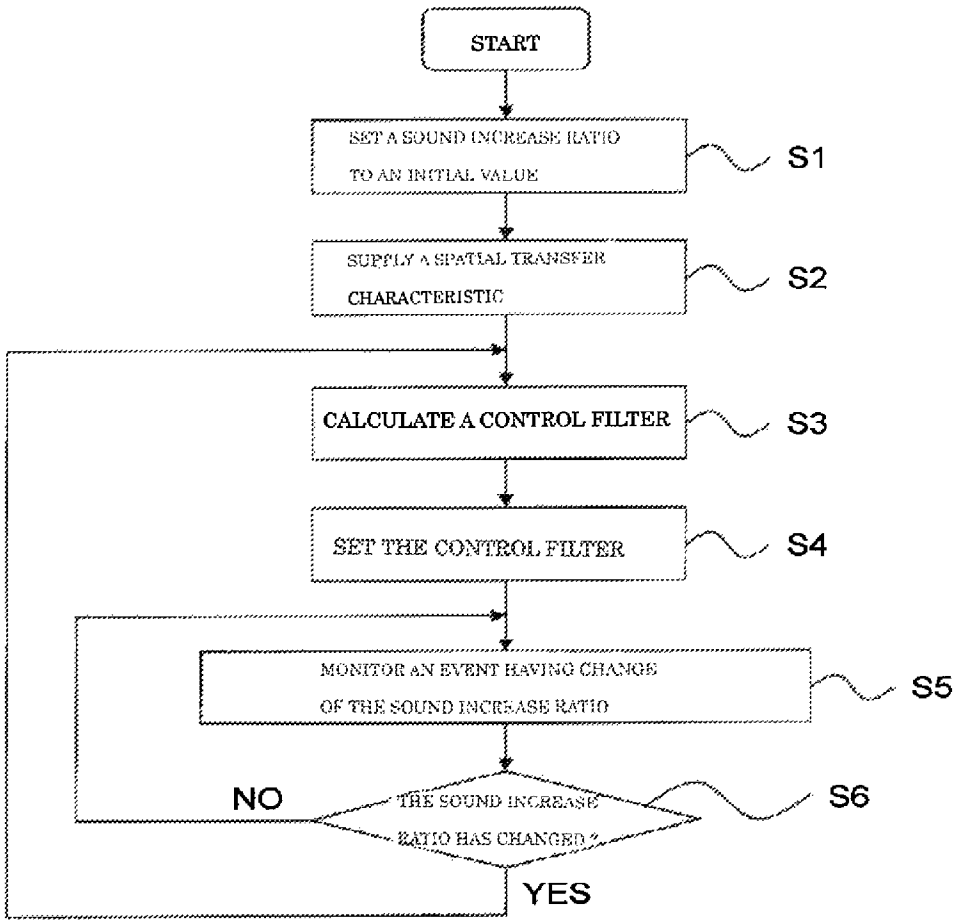
FIG. 13 is a flow chart of processing of sound field control method according to the first embodiment.

FIG. 13 is a flow chart of one example of a sound field control method in the sound field control apparatus of the first embodiment.

First, sound increase ratios na and nb are set to an initial value respectively (S1). The initial value may be a predetermined value. Alternatively, the sound increase ratios na and nb last used for sound field-control in the sound field control apparatus may be set as the initial value. Other various methods may be used.

Next, a spatial transfer characteristic is supplied (S2). Moreover, after the spatial transfer characteristic is supplied, it may be maintained until different spatial transfer characteristic is supplied.

Next, based on the spatial transfer characteristic and the sound increase ratios na and nb, a control filter is calculated (S3).

Next, the calculated filter is set to a calculated value (S4).

Hereafter, until an event to change the control filter occurs, a status of this control filter is maintained. Here, the event to change the sound increase ratios na and nb is explained.

At S5, it is monitored whether the event to change the sound increase ratios na and nb is occurred.

For example, when a listener has changed the sound increase ratios na and nb, this event is detected (S6). Processing is returned to S3, and the control filter is calculated and set again.

Moreover, this method is one example. As the method for controlling a sound field in sound increase-control, various variations can be applied.

EXAMPLES

Here, by setting a complex amplitude q of the first sound source speaker 10 without control to "l($Wp|_{OFF}$=l)", the control effect is verified using the equations (31) and (32). Moreover, hereafter, as one example of the first embodiment, by setting the increase ratio na of the first area to "2", the first area in which sound pressure increases as +6 dB is created. Furthermore, by setting the increase ratio nb of the first area to "1", the second area in which sound pressure does not change (±0 dB) is created. Under this condition, sound increase-control is thought about.

Figure 3:
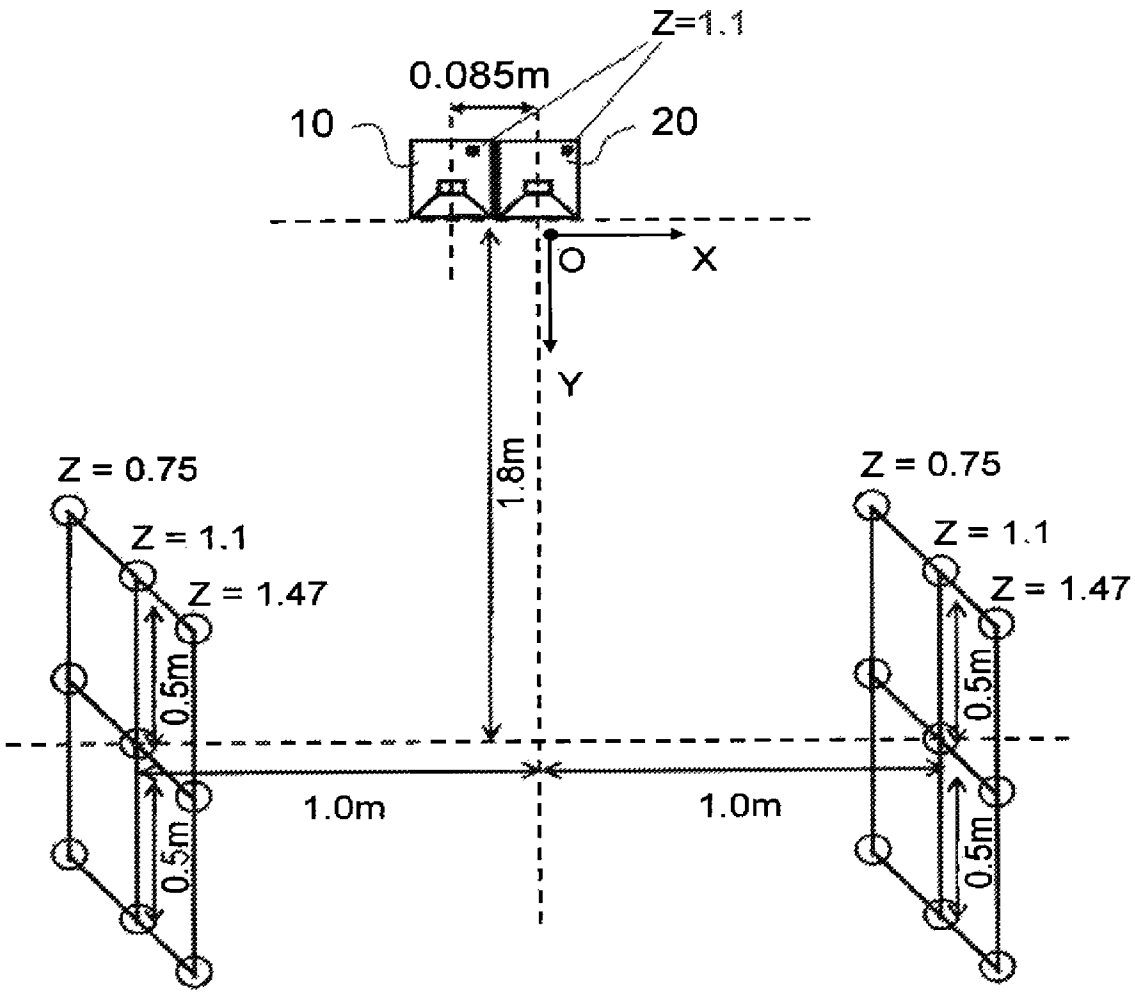
FIG. 3 is another schematic diagram to explain a first area and a second area according to the first embodiment.

FIG. 3 shows a relationship among two sound source speakers, control points in the first area, and control points in the second area. As shown in FIG. 2, a coordinate system is fixed with X-axis as a depth direction, Y-axis as a lateral direction, and Z-axis as a height direction. Hereafter, a unit is meter (m), and a coordinate is noted as (x,y,z).

In FIG. 3, the first sound source speaker 10 is located at (0, −0.085, 1.1), and the second sound source speaker 20 is located at (0, 0, 1.1). Furthermore, in the first area, nine control points are located at M1 (1.3, −1.0, 0.75), M2 (1.8, −1.0, 0.75), M3 (2.3, −1.0, 0.75), M4 (1.3, −1.0, 1.1), M5 (1.8, −1.0, 1.1), M6 (2.3, −1.0, 1.1), M7 (1.3, −1.0, 1.47), M8 (1.8, −1.0, 1.47), M9 (2.3, −1.0, 0.75). On the other hand, in the second area, nine control points are located at N1 (1.3, 1.0, 0.75), N2 (1.8, 1.0, 0.75), N3 (2.3, 1.0, 0.75), N4 (1.3, 1.0, 1.1), N5 (1.8, 1.0, 1.1), N6 (2.3, 1.0, 1.1), N7 (1.3, 1.0, 1.47), N8 (1.8, 1.0, 1.47), N9 (2.3, 1.0, 0.75).

Figure 4:
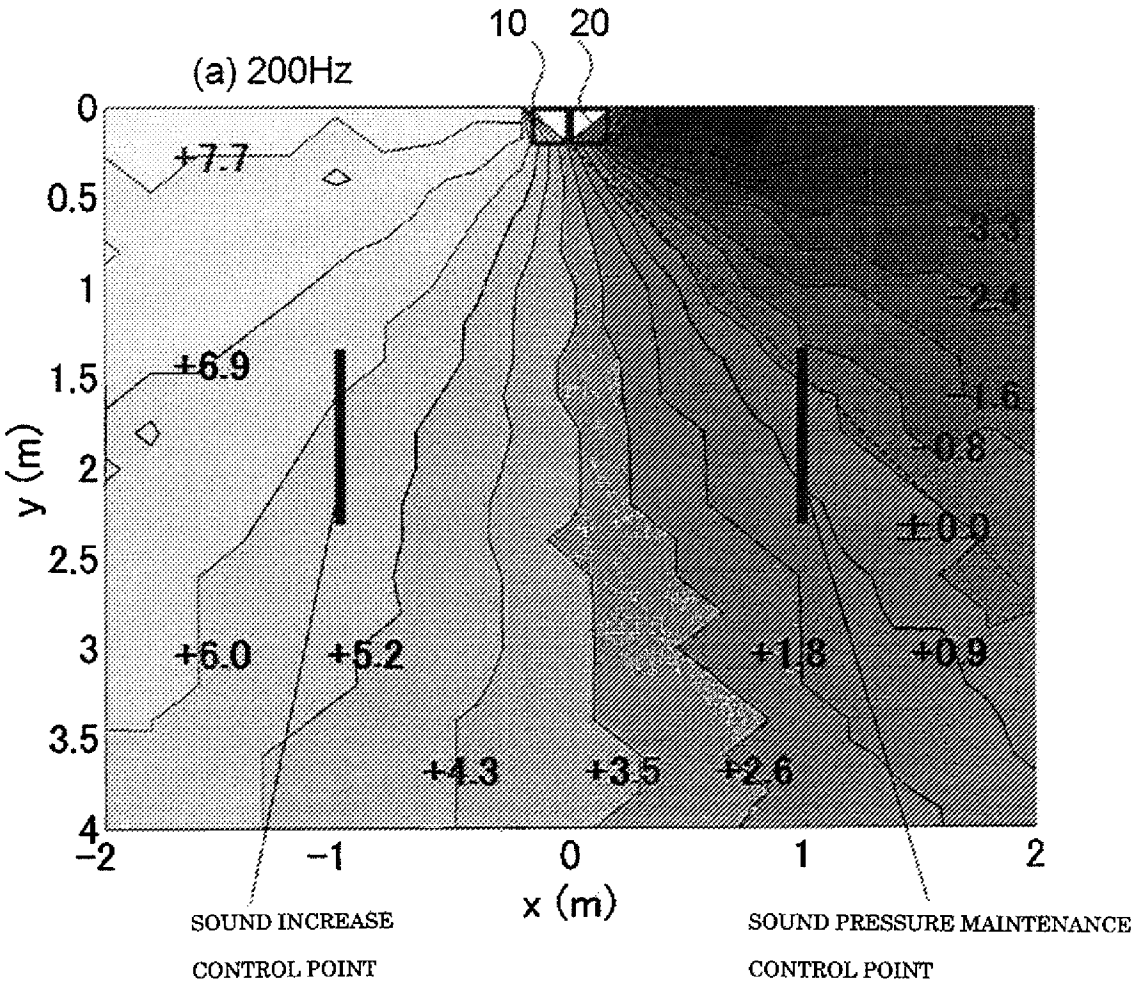
FIG. 4 is a first distribution diagram of sound pressure-change amount by numerical analysis according to the first embodiment.
Figure 5:
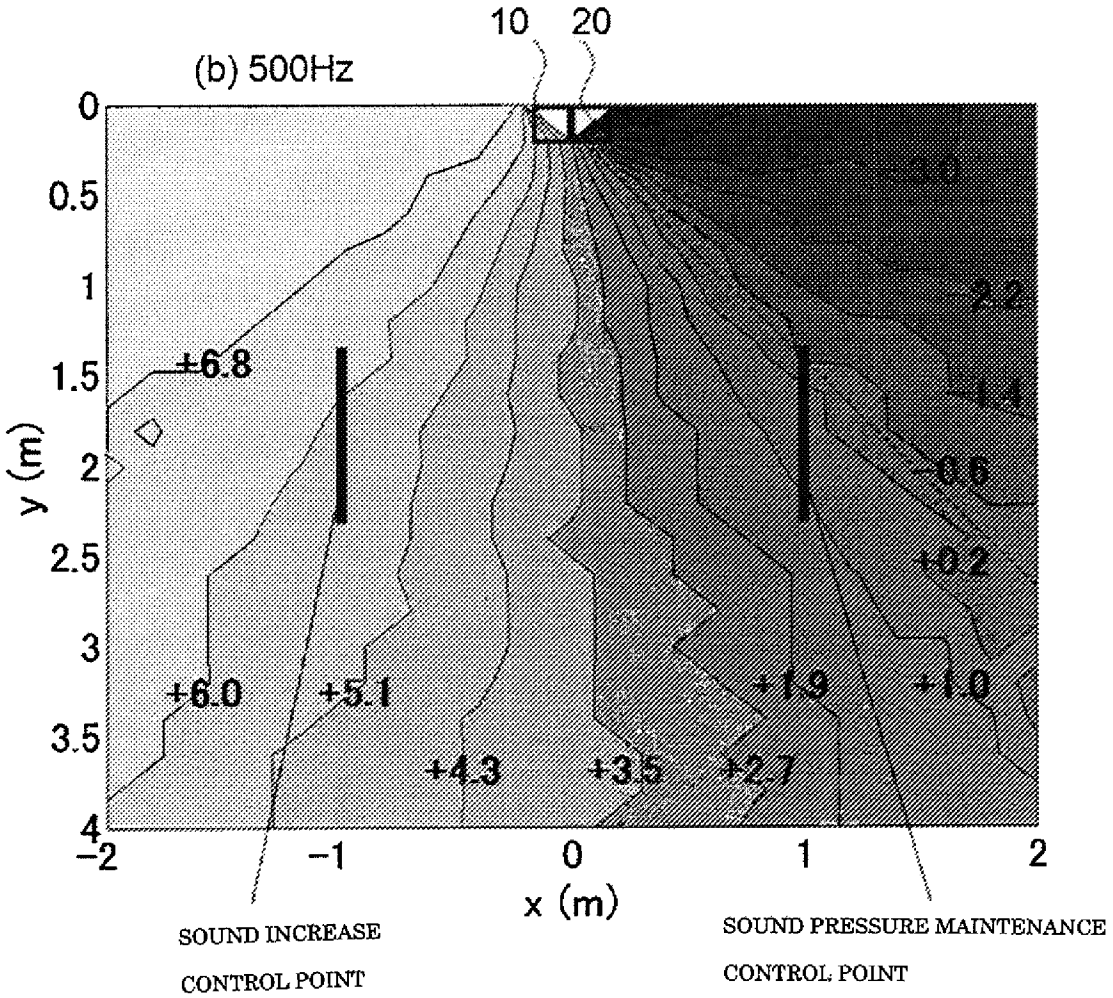
FIG. 5 is a second distribution diagram of sound pressure-change amount by numerical analysis according to the first embodiment.
Figure 6:
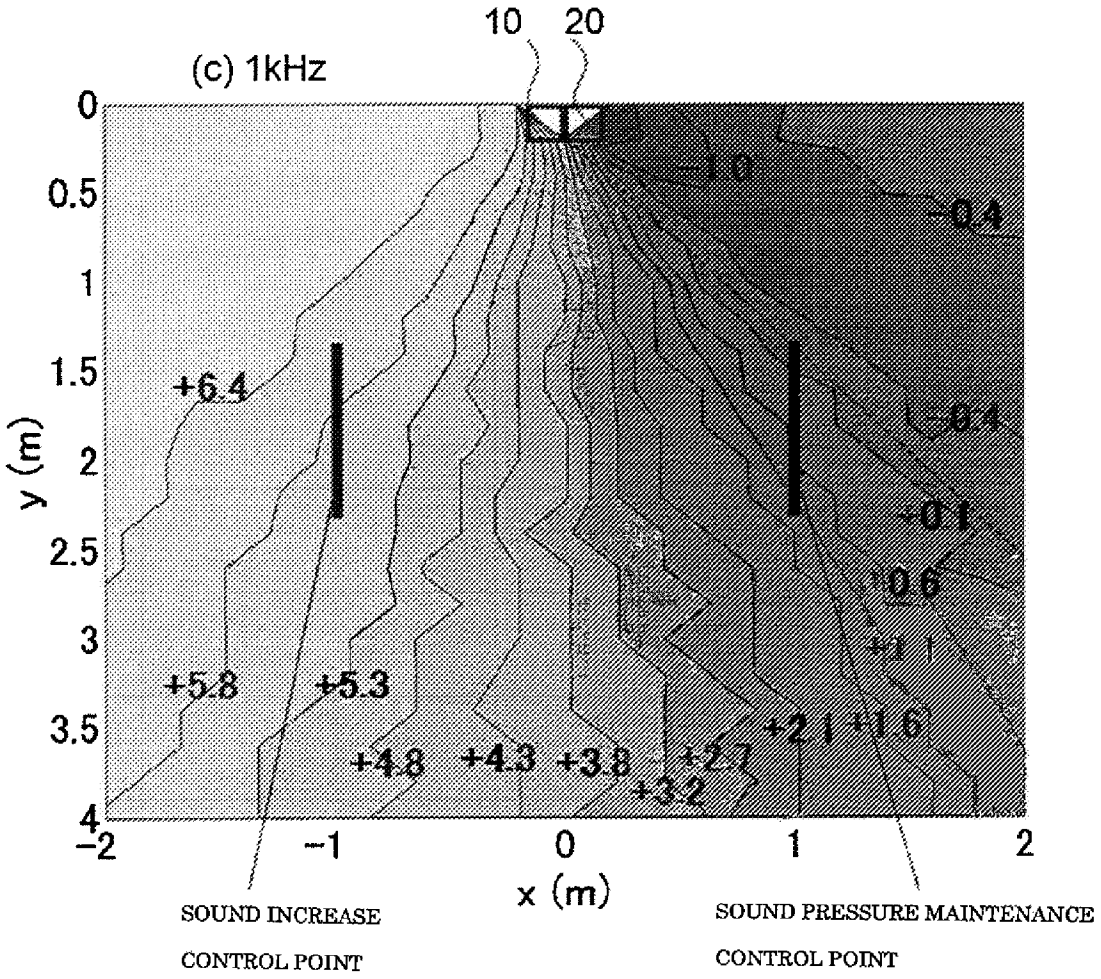
FIG. 6 is a third distribution diagram of sound pressure-change amount by numerical analysis according to the first embodiment.

FIGS. 4, 5 and 6 are distribution diagrams of sound pressure-change amount (relative values) by numerical analysis before and after controlling. FIG. 4 shows a distribution diagram of 200 Hz band, FIG. 5 shows a distribution diagram of 500 Hz band, and FIG. 6 shows a distribution diagram of 1 kHz band. As shown in FIGS. 4-6, as to all of 200 Hz band, 500 Hz band and 1 kHz band, the first area and the second area are created centering around the control point.

Figure 7:
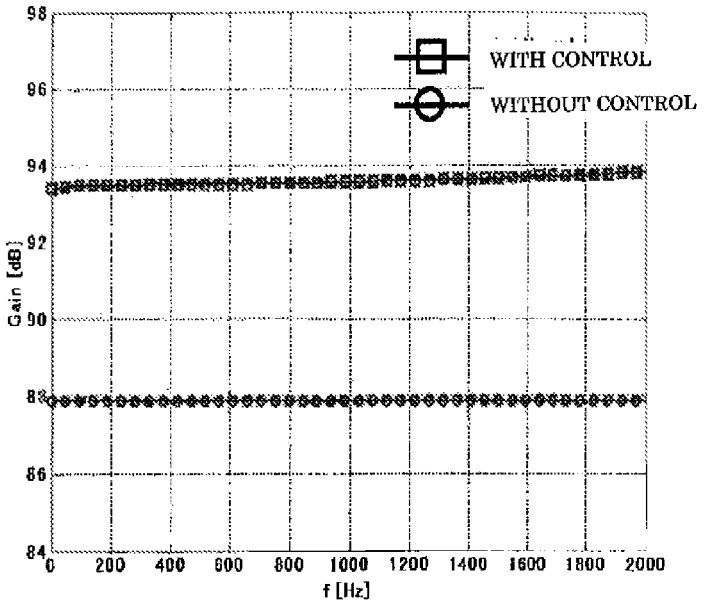
FIG. 7 is a first diagram showing estimation values of sound pressure level by numerical analysis according to the first embodiment.
Figure 8:
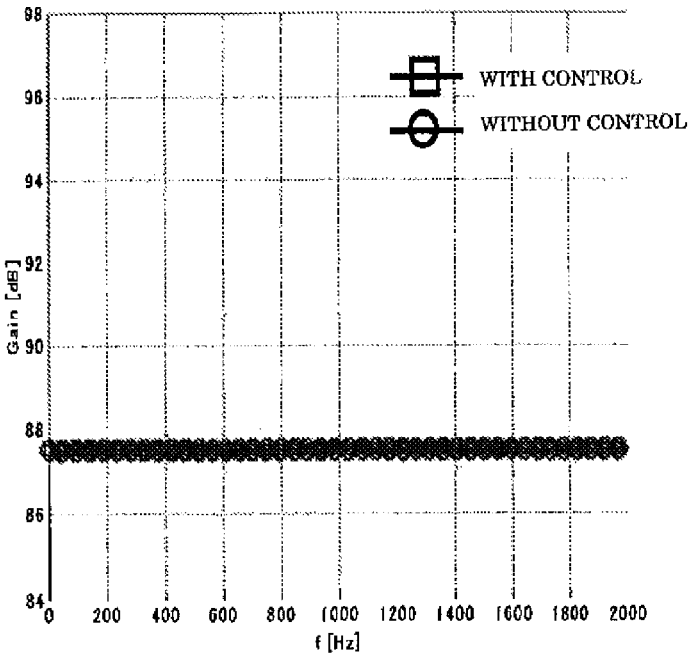
FIG. 8 is a second diagram showing estimation values of sound pressure level by numerical analysis according to the first embodiment.

FIGS. 7 and 8 are diagrams showing estimation values of sound pressure level by numerical analysis before and after controlling. FIG. 7 shows an estimated value at a center control point M5 (1.8, −1.0, 1.1) in the first area, and FIG. 8 shows an estimated value at a center control point N5 (1.8, 1.0, 1.1) in the second area. Furthermore, in FIGS. 7 and 8, circle plots represent a status before controlling, and rectangle plots represent a status after controlling. As shown in FIGS. 7 and 8, sound increase effect of the sound increase ratio "na=2" (nearby +6 dB) is obtained in the first area, and sound pressure-maintenance effect of the sound increase ratio "nb=1" (nearby ±0 dB) is obtained in the second area.

Figure 9:
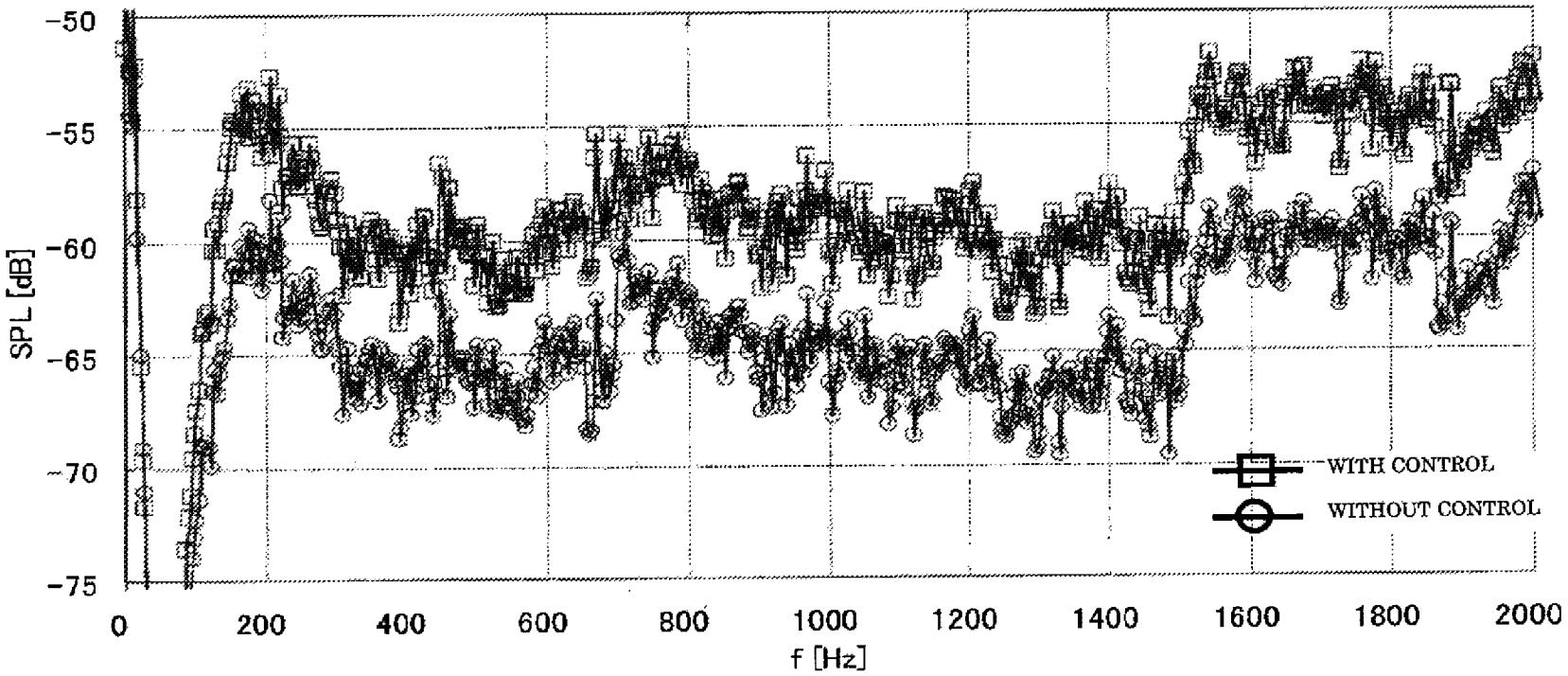
FIG. 9 is a first diagram showing measurement values of sound pressure level by numerical analysis according to the first embodiment.
Figure 10:
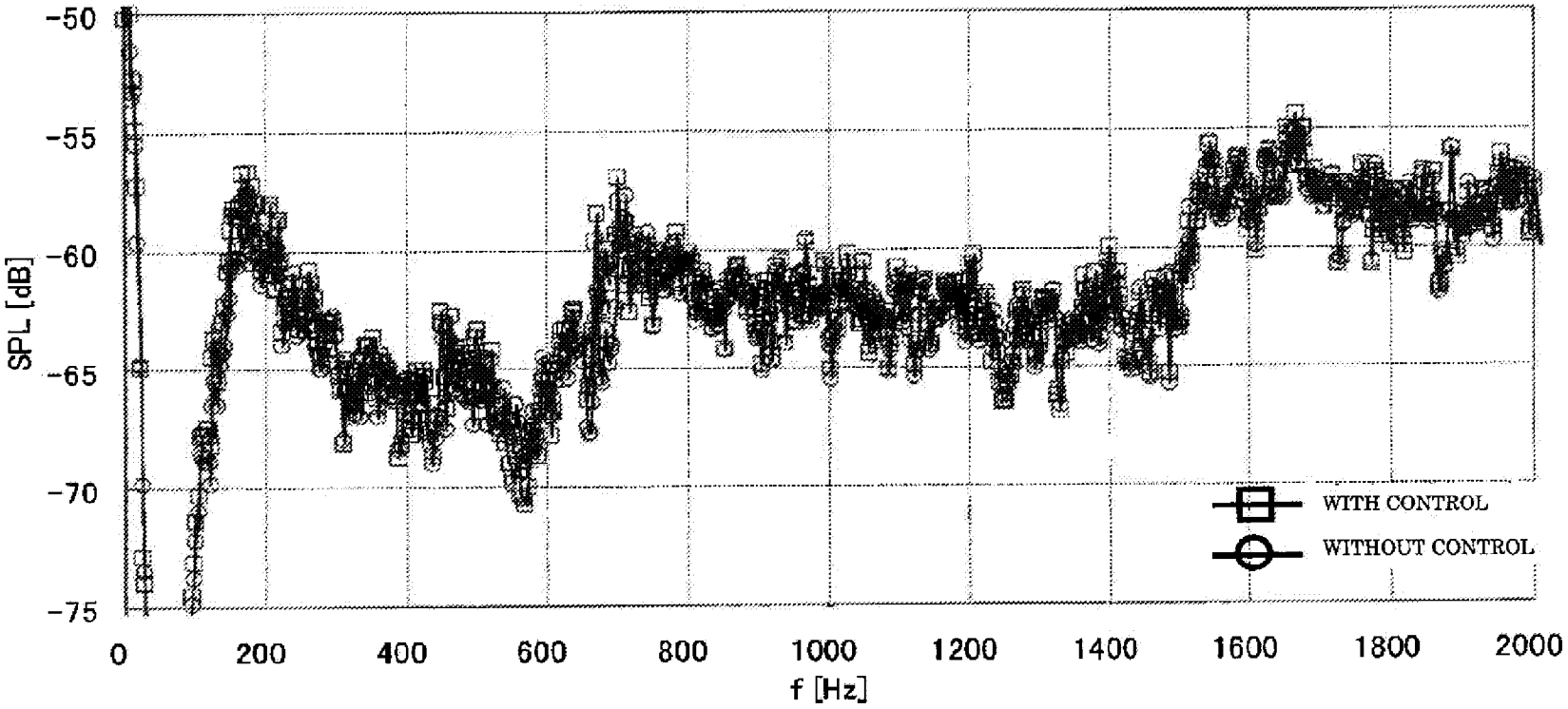
FIG. 10 is a second diagram showing measurement values of sound pressure level by numerical analysis according to the first embodiment.

FIGS. 9 and 10 are diagrams showing measurement values of sound pressure level by numerical analysis before and after controlling. FIG. 9 shows a measurement value at the center control point M5 (1.8, −1.0, 1.1) in the first area, and FIG. 10 shows a measurement value at the center control point N5 (1.8, 1.0, 1.1) in the second area. As shown in FIGS. 9 and 10, in the same way as the estimation value by numerical analysis, sound increase effect of the sound increase ratio "na=2" (nearby +6 dB) is obtained in the first area, and sound pressure-maintenance effect of the sound increase ratio "nb=1" (nearby ±0 dB) is obtained in the second area.

Figure 11A:
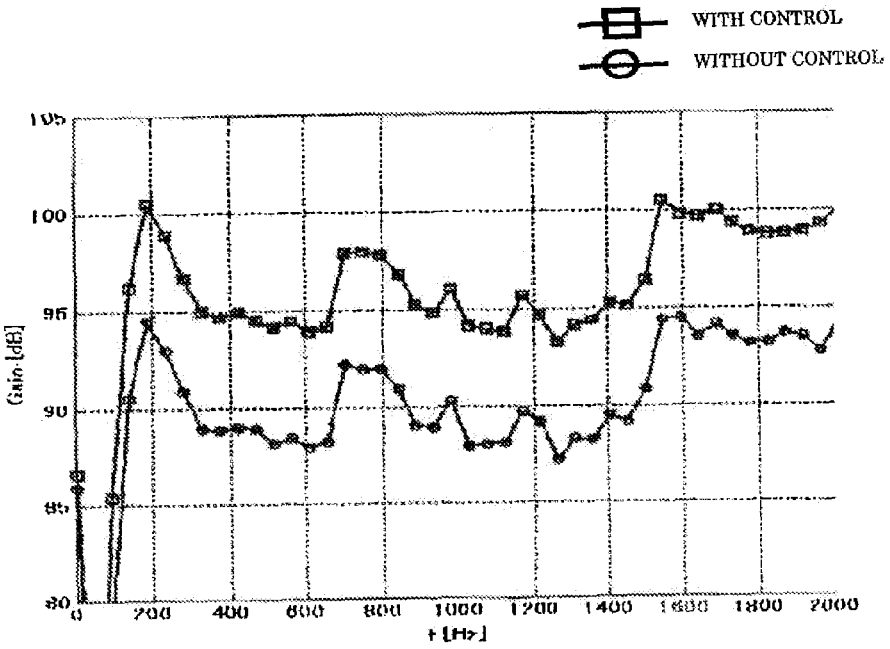
FIGS. 11A-11D are comparison examples of control effect according to the first embodiment.
Figure 11B:
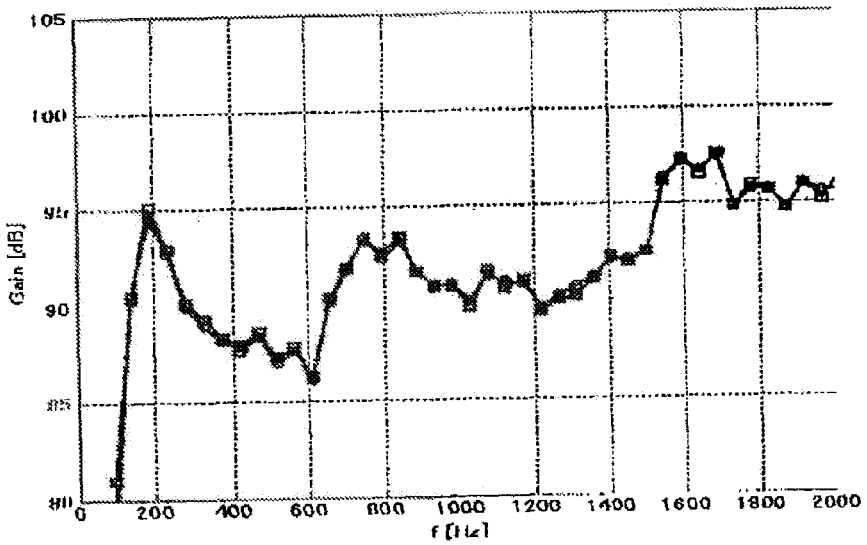
Figure 11C:
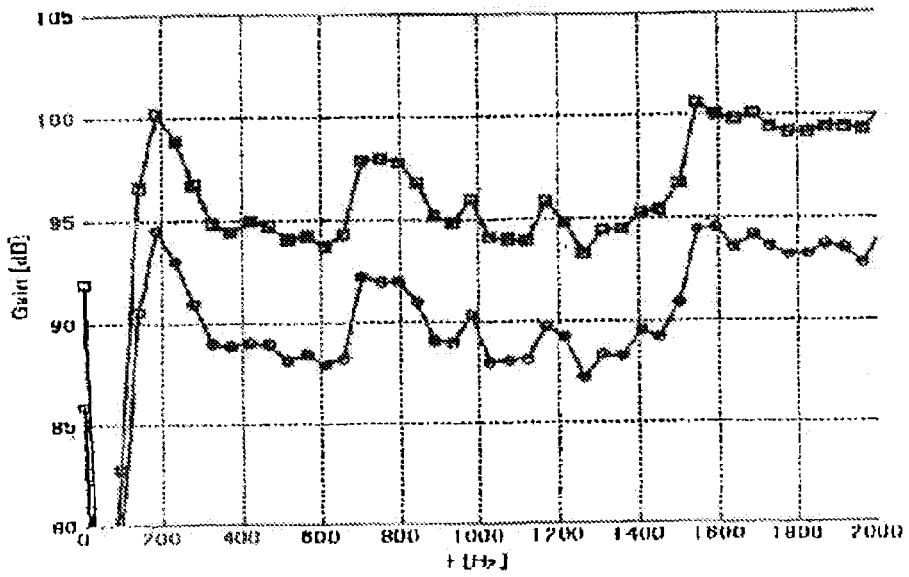
Figure 11D:
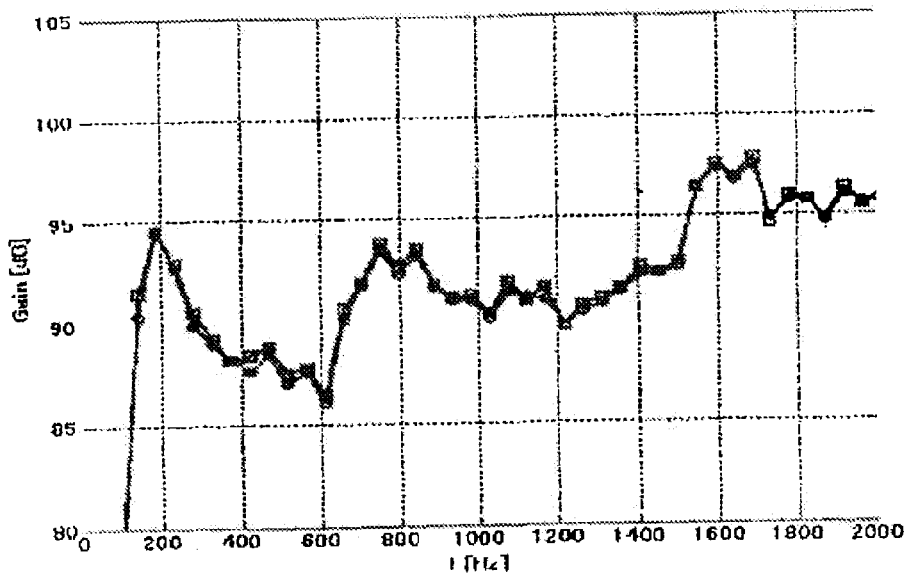

FIGS. 11A~11D are comparison examples of the control effect by using three sound source speakers (one main sound source and two control sound sources) and the control effect by two (proposed) sound source speakers. FIG. 11A shows the control effect at the control point M5 (1.8, −1.0, 1.1) in the first area by using three sound source speakers. FIG. 11B shows the control effect at the control point N5 (1.8, 1.0, 1.1) in the second area by using three sound source speakers. FIG. 11C shows the control effect at the control point M5 (1.8, −1.0, 1.1) in the first area by using two (proposed) sound source speakers. FIG. 11D shows the control effect at the control point N5 (1.8, 1.0, 1.1) in the second area by using two (proposed) sound source speakers.

FIGS. 11A and 11C show the control effect at the same point. As shown in FIGS. 11A and 11C, the sound increase effect obtained by three sound source speakers is nearly obtained by two (fewer) sound source speakers. Furthermore, FIGS. 11B and 11D show the control effect at the same point. As shown in FIGS. 11B and 11D, the sound pressure-maintenance effect obtained by three sound source speakers is nearly obtained by two (fewer) sound source speakers. Accordingly, by two sound source speakers, the present proposal able to show the same ability as the method by at least three sound source speakers has clearly priority.

Moreover, in the first embodiment, as mentioned-above, the spatial transfer characteristic is previously stored in the first storage unit 40. However, by replaying a test sound such as random noise or TPS (Time-Stretched-Pulse) from each speaker and by recording the test sound via a microphone, the operation processing apparatus 200 can calculate the spatial transfer characteristic. By replaying not the test sound but a general contents sound, the spatial transfer characteristic can be obtained. The microphone may be a single device including a microphone function only, or may be an external controller (such as a remote controller) including the microphone function.

Furthermore, as mentioned-above, the first area is an area in front of the first sound source speaker, and the second area is a surrounding area of the first area. However, the first area and the second area are not limited thereto, and may be located at arbitrary position. Furthermore, the first area and the second area may be previously fixed, or variably located.

Furthermore, purpose for sound increase and sound reduction is not limited. For example, as a first case, a listener listens to a sound with a large volume (large acoustic) in the first area only. As a second case, some listener listens to a sound with a large volume while another listener listens to the sound with smaller volume than the first area (or a regular volume, or a smaller volume than the regular volume) in the second area. As a third case, a person having poor hearing listens to a sound with a volume increased in the first area while a person having normal hearing listens to the sound with a regular volume. Briefly, various cases are considered.

Furthermore, for example, by regarding the control effect for the first area as a main body, the sound field-control can be separated to following two patterns (sound increase-control, sound reduction-control). Briefly, "sound increase-control" includes "sound pressure is increased in the first area while sound pressure is maintained in the second area", "sound pressure is increased in the first area while sound pressure is reduced in the second area", and "sound pressure is increased in the first area while sound pressure is increased in the second area". On the other hand, "sound reduction-control" includes "sound pressure is reduced in the first area while sound pressure is maintained in the second area", "sound pressure is reduced in the first area while sound pressure is increased in the second area", and "sound pressure is reduced in the first area while sound pressure is reduced in the second area".

According to the sound field control apparatus and the method thereof according to the first embodiment, when a sound coming from a common sound source is transferred to two areas, respective sound pressures of the two areas can be controlled.

(The Second Embodiment)

Figure 14:
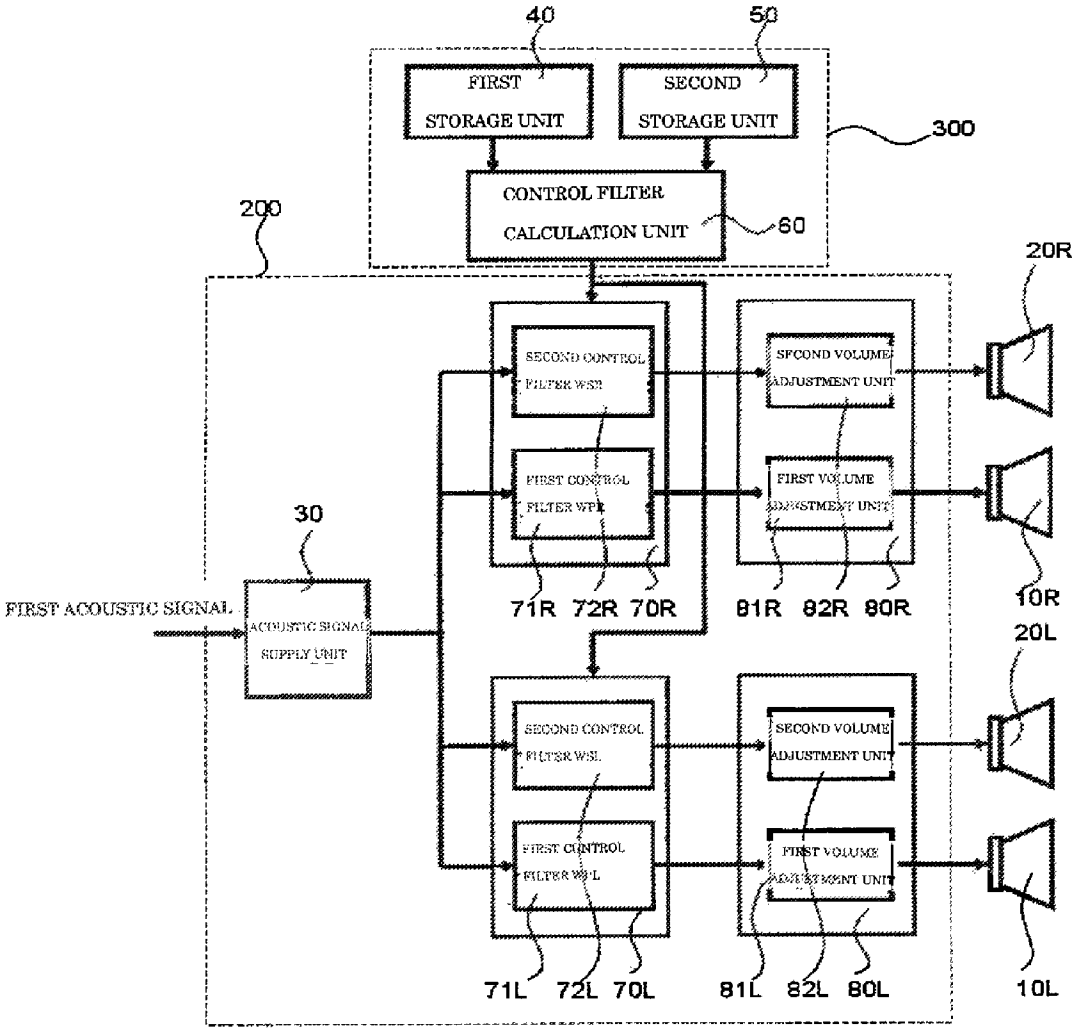
FIG. 14 is a block diagram of the sound field control apparatus according to a second embodiment.

FIG. 14 is a block diagram of a sound field control apparatus 110 according to the second embodiment. As the sound field control apparatus 110, the sound control apparatus 100 for monaural-replay in FIG. 1 is extended to that for stereophonic-replay (L/R-2CH).

In the sound field control apparatus 110 of FIG. 4, the first sound source speaker 10 and the second sound source speaker 20, the control filter 70, and the volume adjustment unit 80, are respectively prepared as two sets for L-CH (left channel) and R-CH (right channel). Moreover, in FIG. 14, L for L-CH is noted after the sign, and R for R-CH is noted after the sign.

The acoustic signal supply unit 30 supplies an acoustic signal for L-CH to a control filter 70L, and supplies an acoustic signal for R-CH to a control filter 70R. The first storage unit 40 supplies spatial transfer characteristics (radiation impedance) to the control filter calculation unit 60. The spatial transfer characteristics represent respective characteristics from the first sound source speakers 10L and 10R, the second sound source speakers 20L and 20R to the first area and the second area. These spatial transfer characteristics are stored in the storage device 300.

The control filter calculation unit 60 respectively calculates coefficients of a control filter 70L (a coefficient WpL of a first control filter 71L, a coefficient WsL of a second control filter 72L), and coefficients of a control filter 70R (a coefficient WpR of a first control filter 71R, a coefficient WsR of a second control filter 72R). A method for calculating the coefficients is same as that of the first embodiment. Accordingly, detail explanation thereof is omitted.

By using a first acoustic signal (obtained from the acoustic signal supply unit 30) and each coefficient (calculated by the control filter calculation unit 60), the control filter 70 convolutes each coefficient (an FIR operation) with the first acoustic signal. Specifically, by convoluting the coefficient WpL with the first acoustic signal, the first control filter 71L calculates an acoustic signal (second acoustic signal) for the first sound source speaker 10L. By convoluting the coefficient WsL with the first acoustic signal, the second control filter 72L calculates an acoustic signal (third acoustic signal) for the second sound source speaker 20L. By convoluting the coefficient WpR with the first acoustic signal, the first control filter 71R calculates an acoustic signal (fourth acoustic signal) for the first sound source speaker 10R. By convoluting the coefficient WsR with the first acoustic signal, the second control filter 72R calculates an acoustic signal (fifth acoustic signal) for the second sound source speaker 20R. The first control filter 71L supplies the second acoustic signal to the first sound source speaker 10L. The first control filter 71R supplies the fourth acoustic signal to the first sound source speaker 10R. The second control filter 72L supplies the third acoustic signal to the second sound source speaker 20L. The second control filter 72R supplies the fifth acoustic signal to the second sound source speaker 20R.

Figure 15:
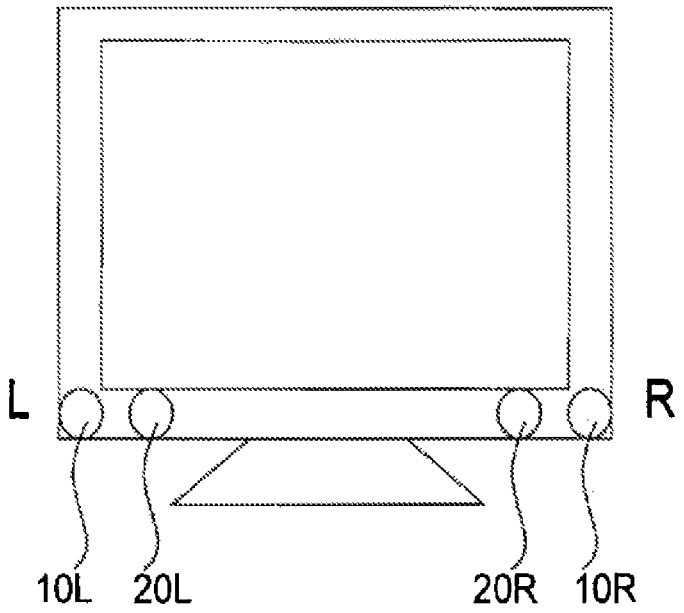
FIG. 15 is a schematic diagram of application example of the sound field control apparatus according to the second embodiment.

FIG. 15 is a schematic diagram that the sound field control apparatus 110 of FIG. 14 is applied to an image display device such as a television. As a position to locate each speaker, the first sound source speakers 10L and 10R are located at both edges of a bezel in order not to damage a stereophonic feeling. The second sound source speakers 20L and 20R are adjacently located toward a center of the bezel.

(The Third Embodiment)

Figure 16:
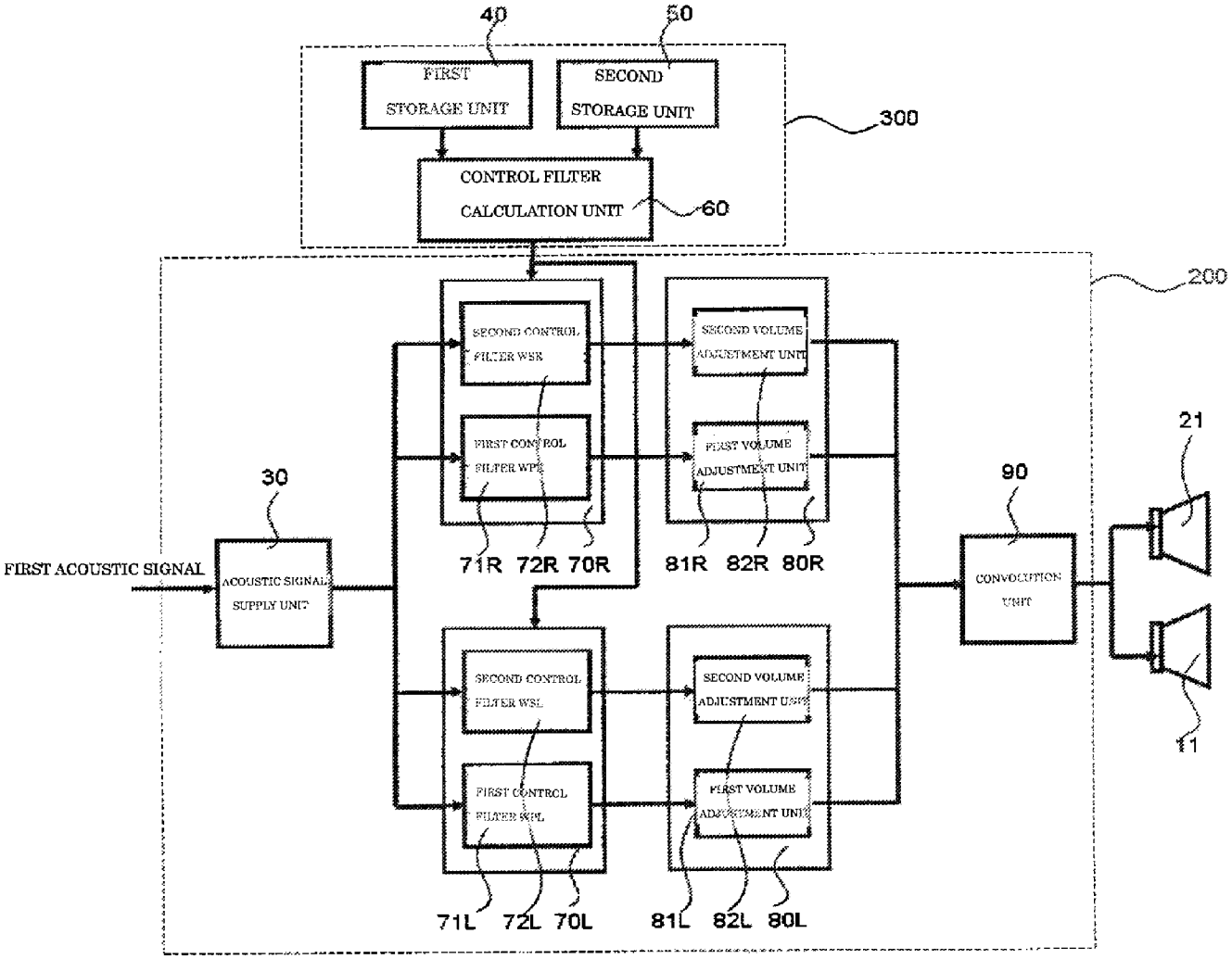
FIG. 16 is a block diagram of the sound field control apparatus according to a third embodiment.

FIG. 16 is a block diagram of a sound field control apparatus 120 according to the third embodiment. In place of the first sound source speakers 10L and 10R, and the second sound source speakers 20L and 20R of the sound field control apparatus 120 in FIG. 14, the sound field control apparatus 120 includes a first sound source speaker 11 (commonly used for L/R-2CH) and a second sound source speaker 21 (commonly used for L/R-2CH).

The acoustic signal supply unit 30 supplies an acoustic signal for L-CH to the control filter 70L, and supplies an acoustic signal for R-CH to the control filter 70R. The first storage unit 40 supplies spatial transfer characteristics (radiation impedance) to the control filter calculation unit 60. The spatial transfer characteristics represent respective characteristics from the first sound source speaker 11 and the second sound source speakers 21 to the first area and the second area. These spatial transfer characteristics are stored in the storage device 300.

The control filter calculation unit 60 respectively calculates coefficients of the control filter 70L (a coefficient WpL of the first control filter 71L, a coefficient WsL of the second control filter 72L), and coefficients of the control filter 70R (a coefficient WpR of the first control filter 71R, a coefficient WsR of the second control filter 72R). A method for calculating the coefficients is same as that of the first embodiment. Accordingly, detail explanation thereof is omitted.

By using the first acoustic signal (obtained from the acoustic signal supply unit 30) and each coefficient (calculated by the control filter calculation unit 60), the control filter 70 convolutes each coefficient (an FIR operation) with the first acoustic signal. Specifically, by convoluting the coefficient WpL with the first acoustic signal, the first control filter 71L calculates the second acoustic signal. By convoluting the coefficient WsL with the first acoustic signal, the second control filter 72L calculates the third acoustic signal. By convoluting the coefficient WpR with the first acoustic signal, the first control filter 71R calculates the fourth acoustic signal. By convoluting the coefficient WsR with the first acoustic signal, the second control filter 72R calculates the fifth acoustic signal.

A convolution unit 90 convolutes the second acoustic signal (calculated by the first control filter 71L) with the fifth acoustic signal (calculated by the second control filter 72R), and calculates an acoustic signal (sixth acoustic signal) for the first sound source speaker 11. Furthermore, the convolution unit 90 convolutes the fourth acoustic signal (calculated by the first control filter 71R) with the third acoustic signal (calculated by the second control filter 72L), and calculates an acoustic signal (seventh acoustic signal) for the second sound source speaker 21. The convolution unit 90 supplies the sixth acoustic signal to the first sound source speaker 11, and supplies the seventh acoustic signal to the second sound source speaker 21.

Figure 17:
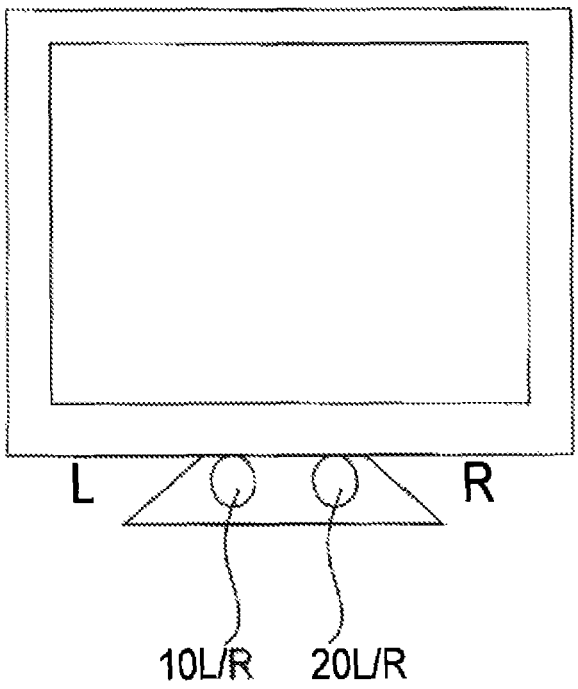
FIG. 17 is a schematic diagram of application example of the sound field control apparatus according to the third embodiment.

FIG. 17 is a schematic diagram that the sound field control apparatus 120 of FIG. 16 is applied to an image display device such as a television. As a position to locate each speaker, the first sound source speakers 11 and 21 are located at both edges of a bezel. More preferably, in order to secure a range of sound pressure-maintenance area of the second area, the first sound source speaker 11 and the second sound source speaker 21 are adjacently located at a lower step or a pedestal of the bezel as a center position of a width of the bezel.

According to the sound field apparatus 120 of the third embodiment, by convoluting a plurality of acoustic signals for one sound source speaker, an effect of respective acoustic signals is maintained. Accordingly, by two sound source speakers, the sound control apparatus 100 for monaural-replay in FIG. 1 can be extended to that for stereophonic-replay.

(The Fourth Embodiment)

Figure 18:
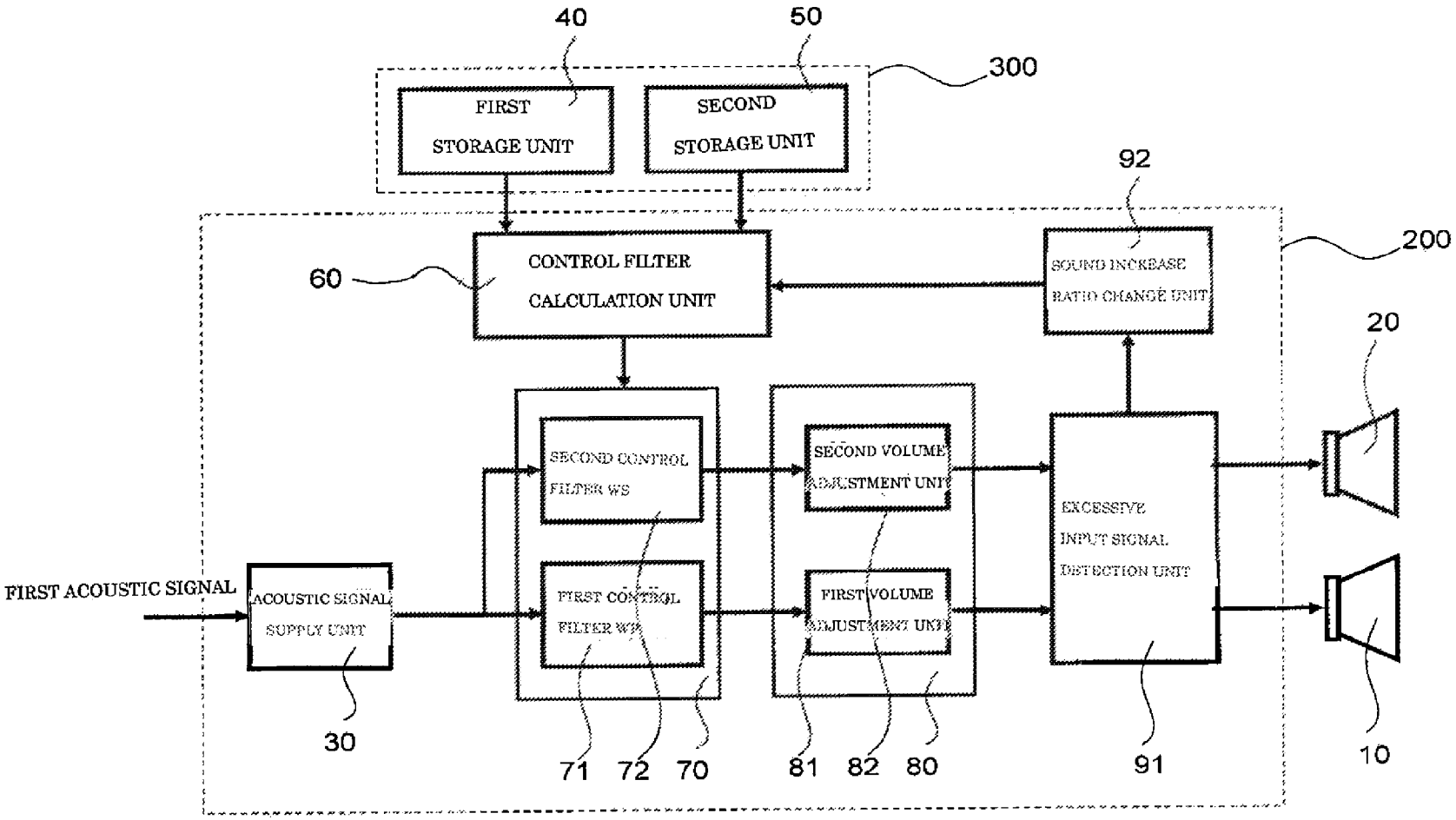
FIG. 18 is a block diagram of the sound field control apparatus according to a fourth embodiment.
Figure 19A:
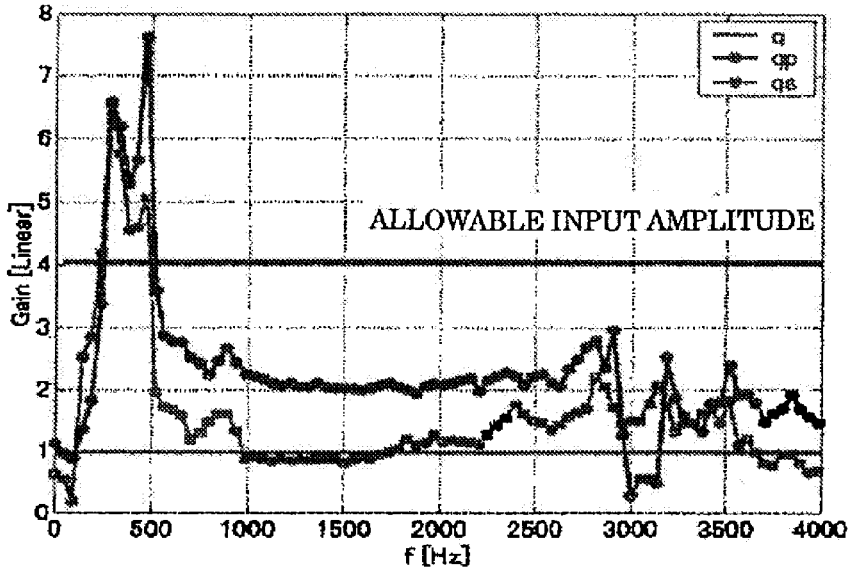
FIGS. 19A-19D are schematic diagrams of control filters according to the fourth embodiment.
Figure 19B:
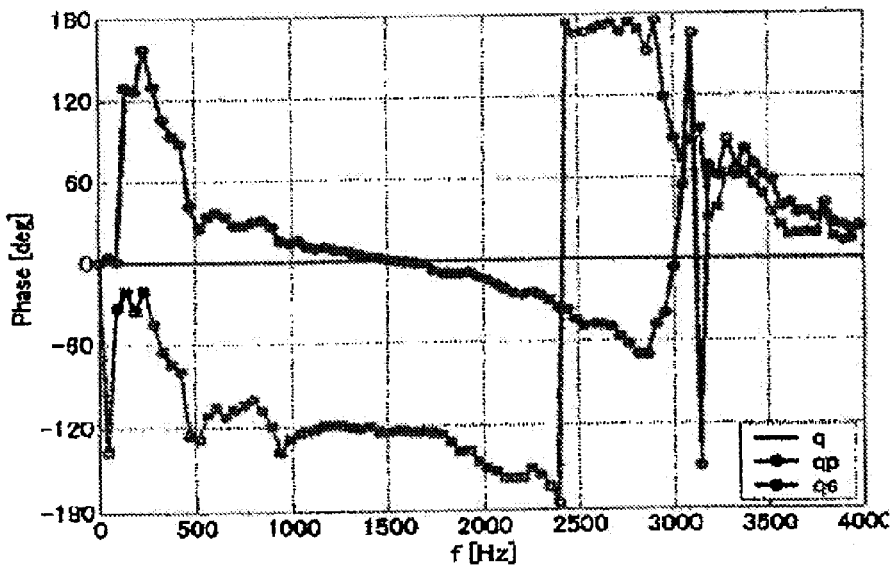
Figure 19C:
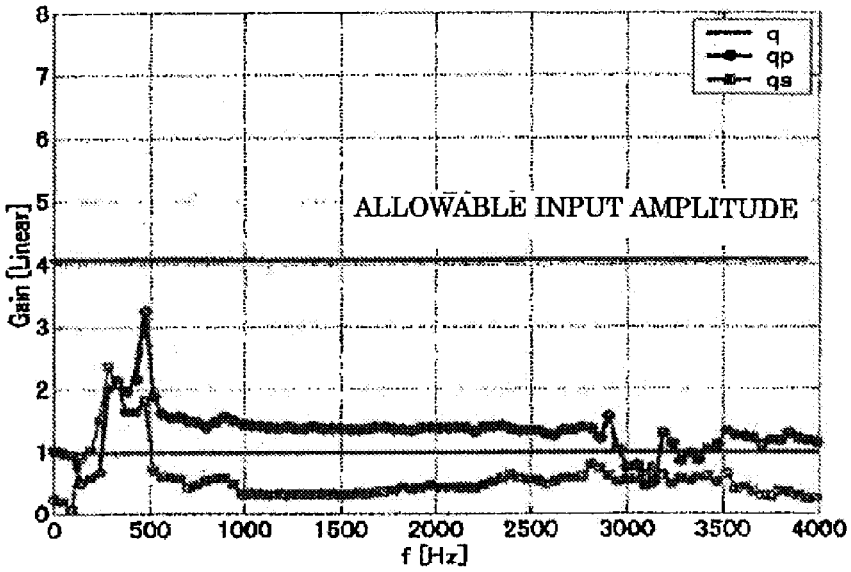
Figure 19D:
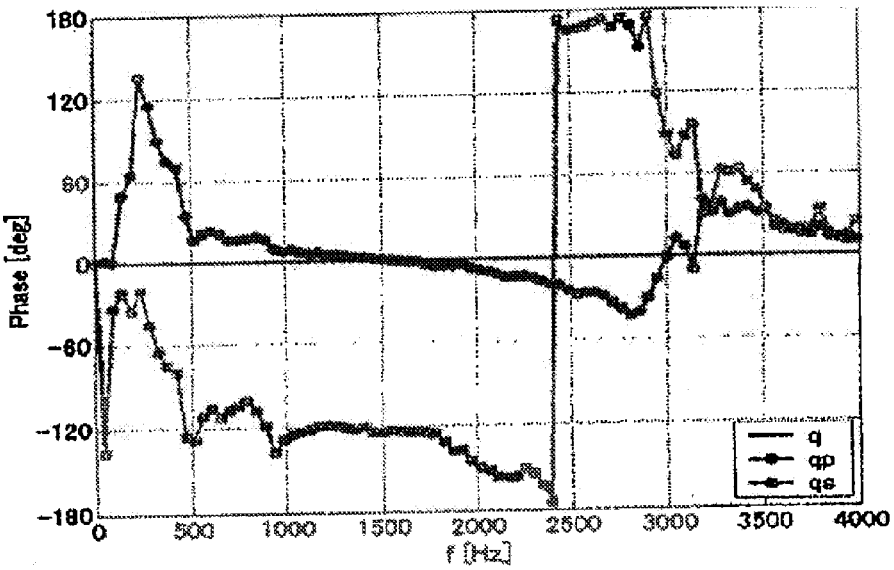

FIG. 18 is a block diagram of a sound field control apparatus 130 according to the fourth embodiment. The sound field control apparatus 130 includes an excessive input signal detection unit 91 and a sound increase ratio change unit 92. Moreover, as to the same unit as the sound field control apparatus 100 of the first embodiment, the same sign is assigned thereto, and detail explanation thereof is omitted.

The excessive input signal detection unit 91 obtains the second acoustic signal and the third acoustic signal amplified by the volume adjustment unit 80. Then, the excessive input signal detection unit 91 detects whether an amplitude (output voltage) of the second acoustic signal is smaller than (or equal to) an allowance amplitude (allowance input voltage) of the first sound source speaker 10. Furthermore, the excessive input signal detection unit 91 detects whether an output voltage of the second acoustic signal is smaller than (or equal to) an allowance input voltage of the second sound source speaker 20. Briefly, the excessive input signal detection unit 91 detects respective excessive inputs of the second acoustic signal and the third acoustic signal for the first sound source speaker 10 and the second sound source speaker 20.

When the excessive input signal detection unit 91 detects the excessive input, i.e., when the output voltage of the second acoustic signal is larger than the allowance input voltage of the first sound source speaker 10, or when the output voltage of the third acoustic signal is larger than the allowance input voltage of the second sound source speaker 20, the sound increase ratio change unit 92 adjusts the output voltage of the acoustic signal so that the output voltage is smaller than the allowance input voltage of the sound source speaker. Specifically, the sound increase ratio change unit 92 changes a sound increase ratio stored in the first storage unit 40 so that the output voltage of the acoustic signal is smaller than the allowance input voltage of the sound source speaker. Here, for example, by gradually reducing the sound increase ratio, when the output voltage is equal to the allowance input voltage, the sound increase ratio change unit 92 completes the change processing. Moreover, the allowance input voltage is determined from a specification (rating input and maximum input) of the first sound source speaker 10 and the second sound source speaker 20.

By using the sound increase ratio changed by the sound increase ratio change unit 92, the control filter calculation unit 60 calculates a coefficient Ws of the first control filter 71 and a coefficient Wp of the second control filter 72. A method for calculating the coefficient is same as that of the first embodiment. Accordingly, detail explanation thereof is omitted.

FIGS. 19A~19D show amplitude and phase of the control filter in the frequency band. Here, as an example, when allowance amplitude of the control filter corresponding to the allowance input voltage is "4", a gain (amplitude) is adjusted so as to be within the allowance amplitude by changing the sound increase ratio. Moreover, as to the phase, relationship thereof does not almost change before and after adjusting.

Moreover, when the excessive input signal detection unit 91 detects an excessive input, it is considered that the volume adjustment unit 80 reduces respective amplitudes of the second acoustic signal and the third acoustic signal. However, when the volume adjustment unit 80 decreases respective amplitudes of the second acoustic signal and the third acoustic signal, a difference (gradient) of sound pressure between the first area and the second area is maintained. However, an absolute sound pressure of the second area is changed (reduced). Accordingly, in the fourth embodiment, by changing the sound increase ratio by the sound increase ratio change unit 92, the output voltage can be restricted to be smaller than the allowance input voltage without reducing a sound pressure of the second area.

As a result, a distortion of sound radiated from the first sound source speaker 10 and the second sound source speaker 20 can be prevented. Furthermore, even if the output voltage is greatly over the allowance input voltage, the first sound source speaker 10 and the second sound source speaker 20 can be prevented from damaging.

(The Fifth Embodiment)

Figure 20:
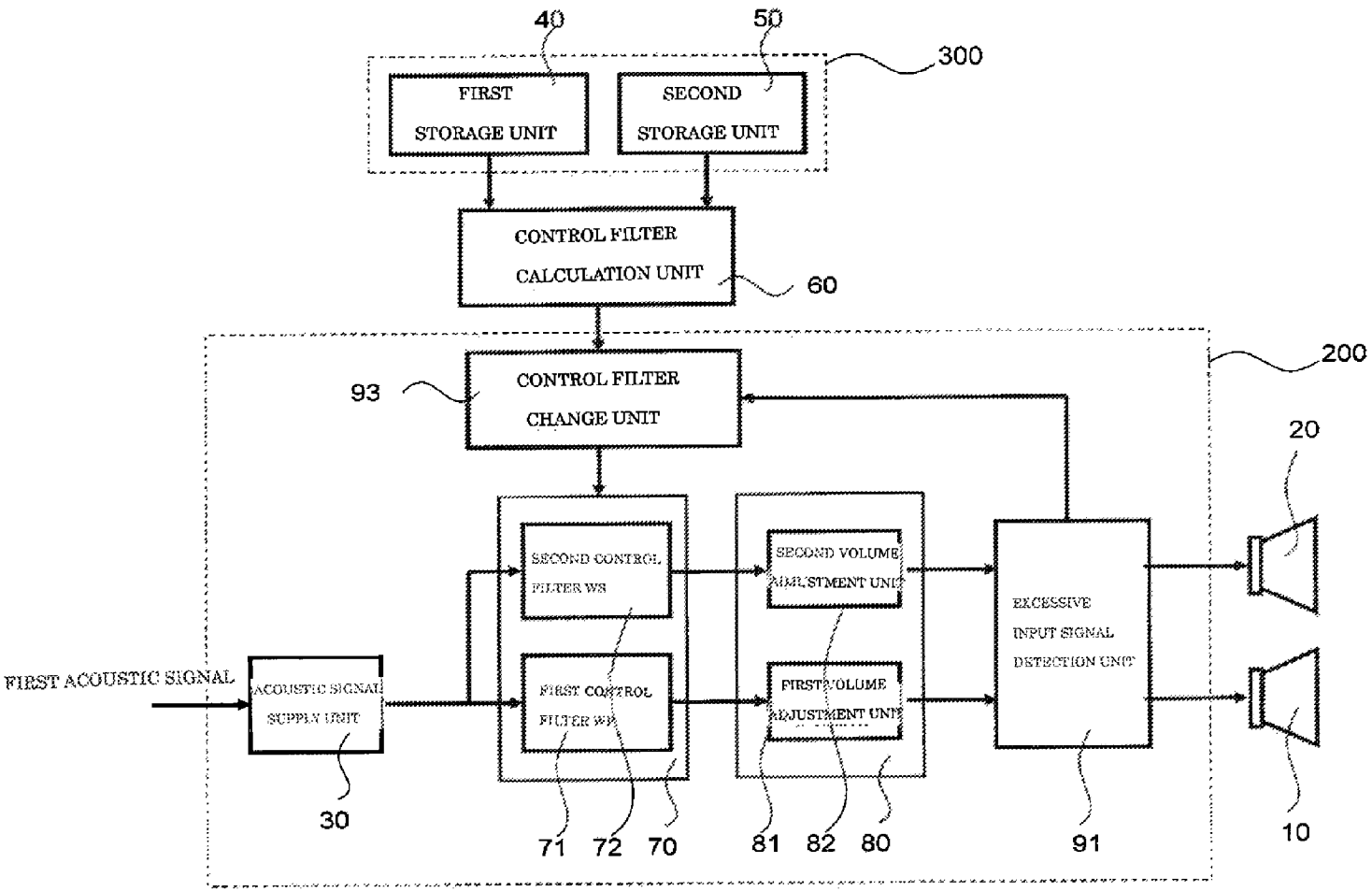
FIG. 20 is a block diagram of the sound field control apparatus according to a fifth embodiment.
Figure 21A:
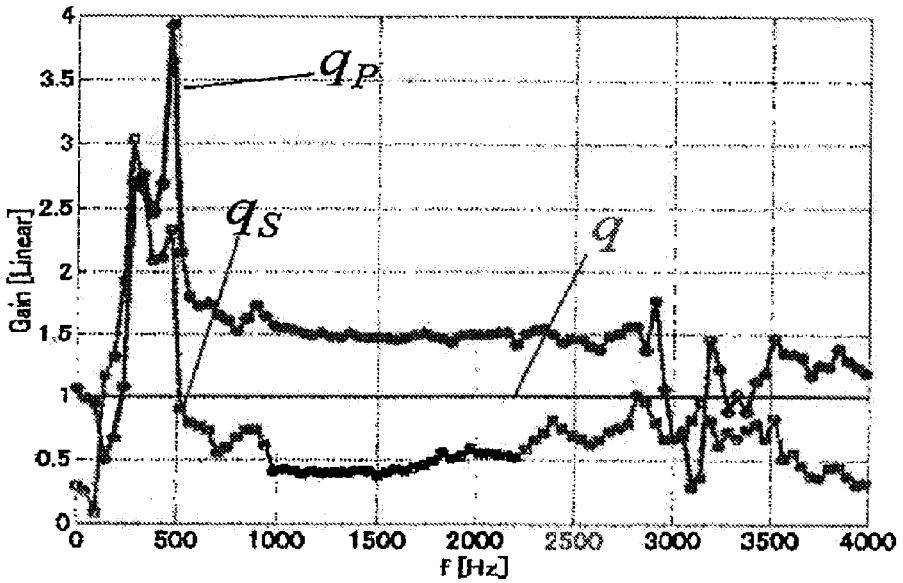
FIGS. 21A-21D are schematic diagrams of control filters according to the fifth embodiment.
Figure 21B:
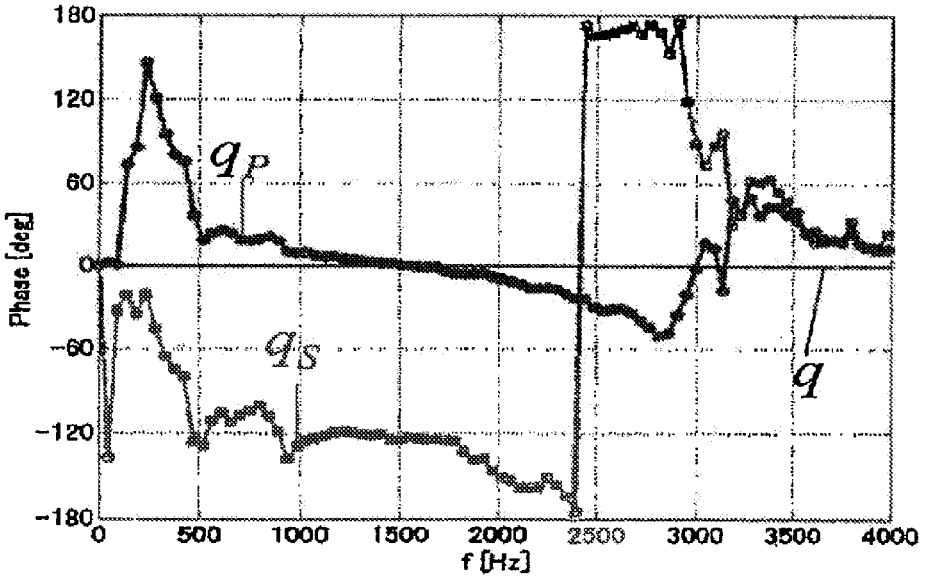
Figure 21C:
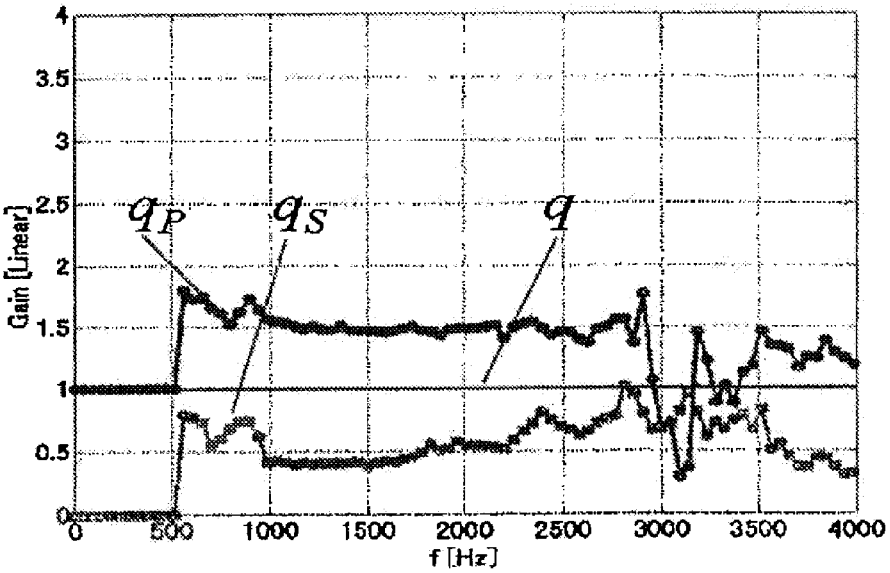
Figure 21D:
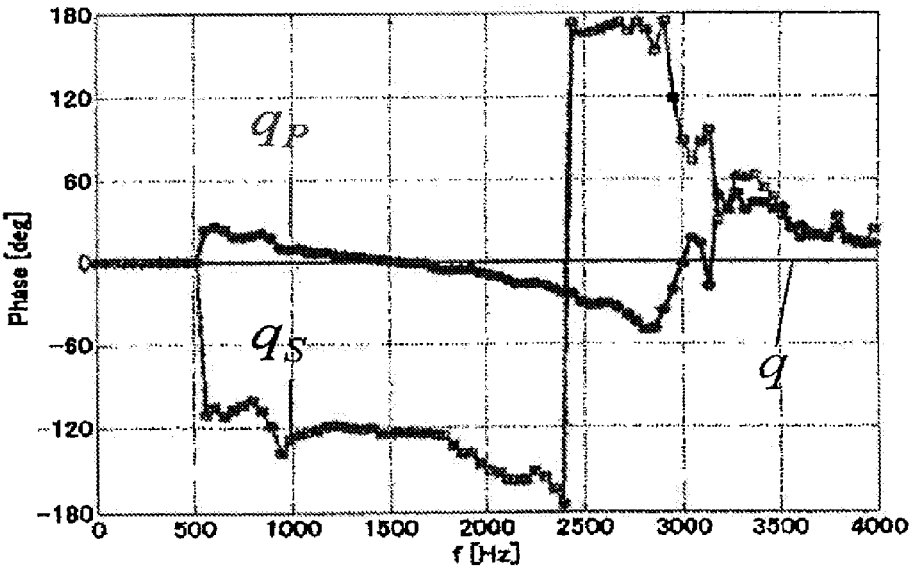
Figure 22A:
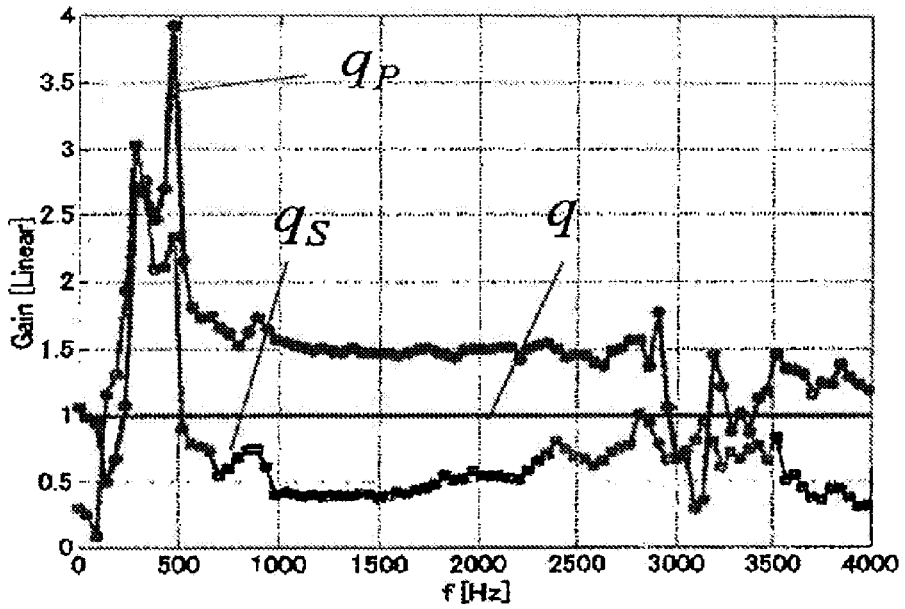
FIGS. 22A-22D are schematic diagrams of control filters according to a modification of the fifth embodiment.
Figure 22B:
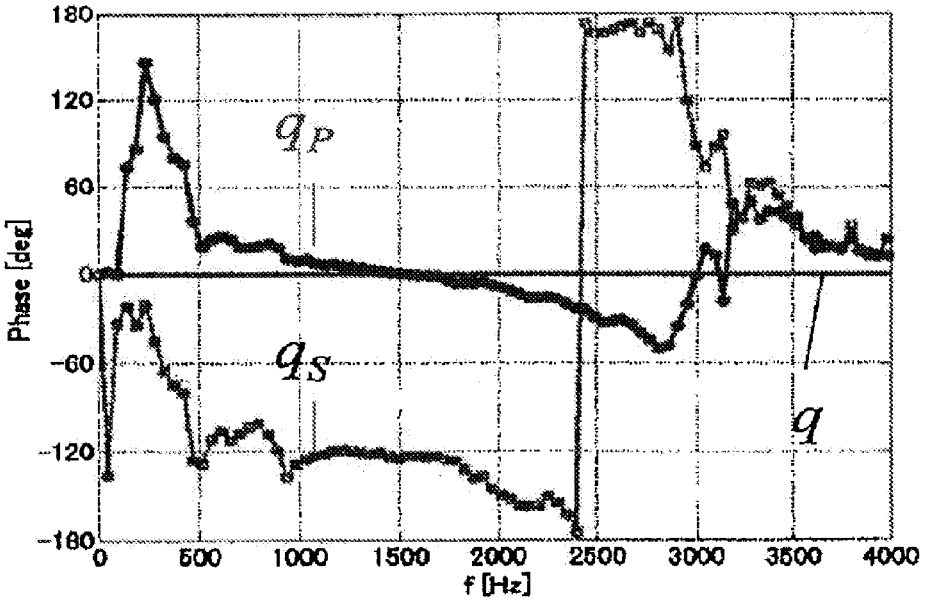
Figure 22C:
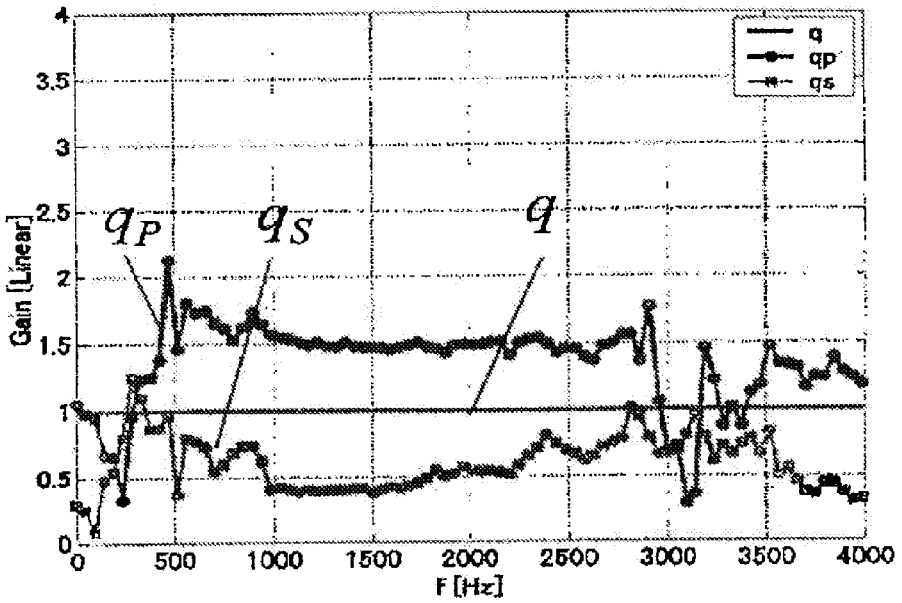
Figure 22D:
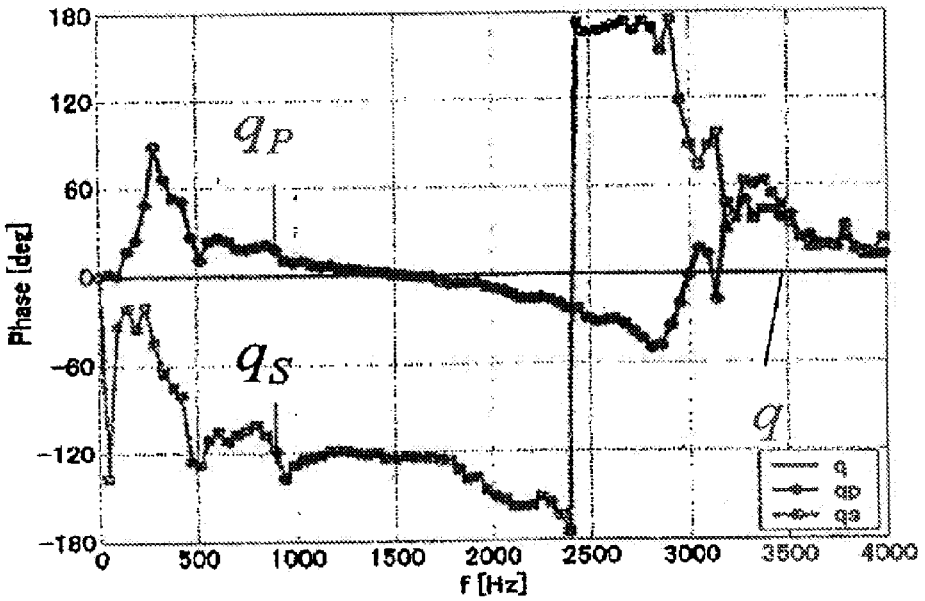

FIG. 20 is a block diagram of a sound field control apparatus 140 according to the fifth embodiment. The sound field control apparatus 140 includes the excessive input signal detection unit 91 and a control filter change unit 93. Moreover, as to the same unit as the sound field control apparatus 100 of the first embodiment, the same sign is assigned thereto, and detail explanation thereof is omitted.

The excessive input signal detection unit 91 obtains the second acoustic signal and the third acoustic signal amplified by the volume adjustment unit 80. Then, the excessive input signal detection unit 91 detects whether an amplitude (output voltage) of the second acoustic signal is smaller than (or equal to) an allowance amplitude (allowance input voltage) of the first sound source speaker 10. Furthermore, the excessive input signal detection unit 91 detects whether an output voltage of the second acoustic signal is smaller than (or equal to) an allowance input voltage of the second sound source speaker 20. Briefly, the excessive input signal detection unit 91 detects respective excessive inputs of the second acoustic signal and the third acoustic signal for the first sound source speaker 10 and the second sound source speaker 20.

When the excessive input signal detection unit 91 detects the excessive input, the control filter change unit 93 adjusts the output voltage of the acoustic signal so that the output voltage is smaller than the allowance input voltage of the sound source speaker. Specifically, the excessive input signal detection unit 91 converts a coefficient Wp of the first control filter 71 and a coefficient Ws of the second control filter 72 (calculated by the control filter calculation unit 60) to a frequency band by FFT and so on. Briefly, amplitude and phase corresponding to the frequency are obtained. Furthermore, in the frequency band that a gain of each control filter is larger than a gain corresponding to the allowance input voltage, amplitude and phase of each filter are cut. Here, in this frequency band, amplitude and phase of the coefficient Wp of the first control filter 71 are regarded as through characteristics (1). On the other hand, amplitude and phase of the coefficient Ws of the second control filter 72 is completely removed (0).

FIGS. 21A~21D show amplitude and phase of the control filter in the frequency band. Here, a control filter having regular characteristics is compared with the control filter from which the frequency band is cut. Here, when the allowance input signal is twice (amplitude 2) as a reference signal, a frequency band smaller than 600 Hz is cut as an excessive input signal component.

As a result, by cutting a frequency band from which the excessive input is occurred, control effect by the increase sound ratio can be provided to other frequency bands. Here, in the frequency band from which the excessive input is occurred, the sound increase ratio is not changed before and after controlling, and the sound without control is continually replayed.

(Modification)

As to the present modification, in FIG. 20, when the excessive input signal detection unit 91 detects the excessive input, the control filter change unit 93 converts a coefficient Wp of the first control filter 71 and a coefficient Ws of the second control filter 72 (calculated by the control filter calculation unit 60) to a frequency band by FFT and so on. Furthermore, as to the frequency band that a gain of each control filter is larger than a gain corresponding to the allowance input voltage, the control filter change unit 93 changes the sound increase ratio so that the output voltage of the acoustic signal is smaller than the allowable input voltage of the sound source speaker.

As to the frequency band that a gain of each control filter is larger than a gain corresponding to the allowance input voltage, by using the sound increase ratio changed, the control filter change unit 93 changes a coefficient Wp of the first control filter 71 and a coefficient Ws of the second control filter 72.

FIGS. 22A~22D show amplitude and phase of the control filter in the frequency band. Specifically, when the sound increase ratio is reduced in the frequency band 200 Hz~600 Hz, amplitude and phrase of the control filter are shown. Here, in comparison with a regular sound increase ratio "n=2 (+6 dB)", the sound increase ratio "n=1.4 (+4 dB)" is set for the frequency band 200 Hz~600 Hz.

As a result, while amplitude of the control filter of the frequency band from which the excessive input is occurred is restricted to be smaller than the allowance amplitude, the maximum control effect in this range can be provided.

(The Sixth Embodiment)

Figure 23:
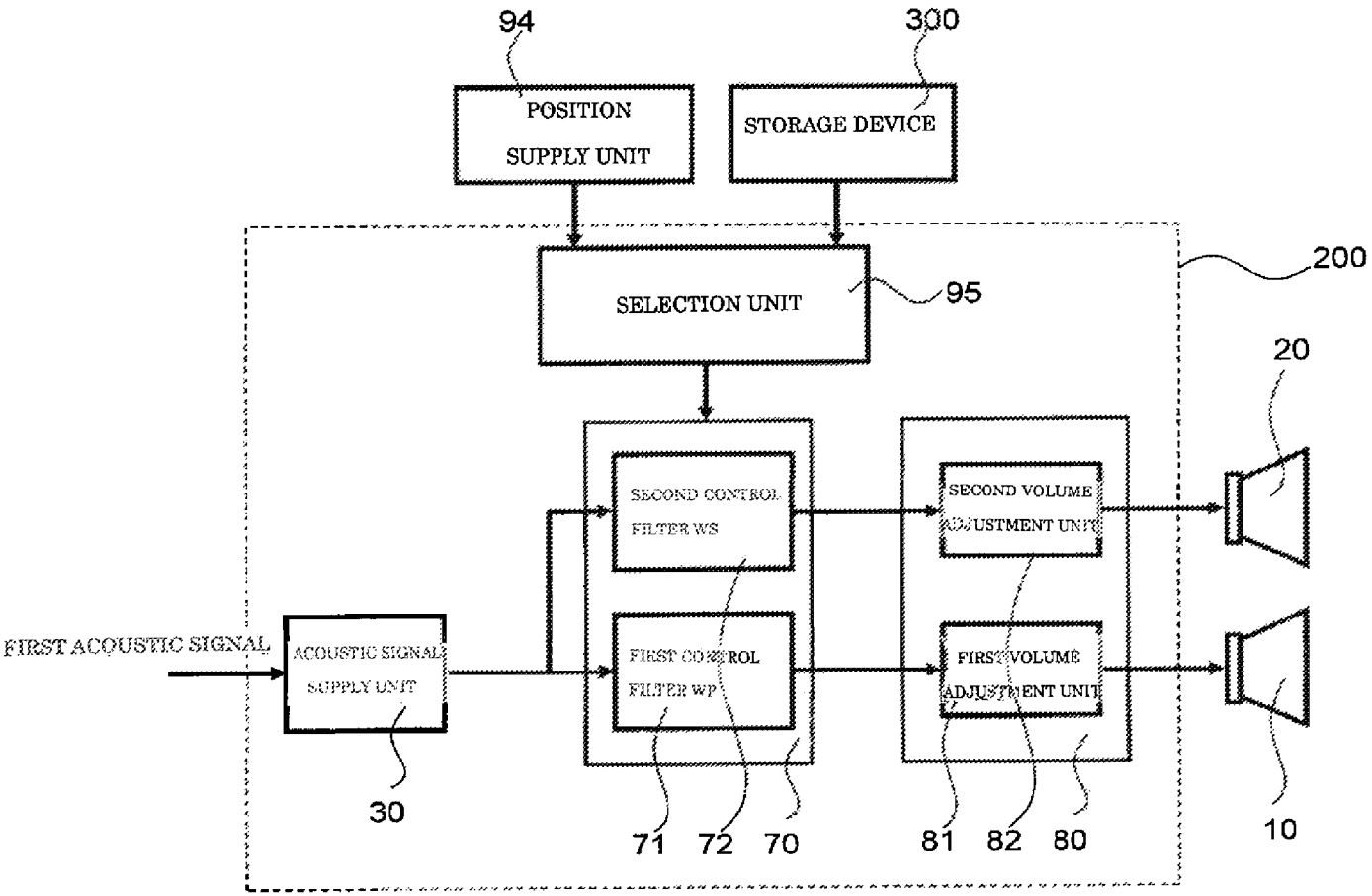
FIG. 23 is a block diagram of the sound field control apparatus according to a sixth embodiment.

FIG. 23 is a block diagram of a sound field control apparatus 150 according to the sixth embodiment. In the sound field control apparatus 150, the control filter calculation unit 60 is not equipped, and the storage device 300 previously stores coefficients of the control filter 70. Furthermore, a position supply unit 94 to supply positions of the first area and the second area to a selection unit 95, and the selection unit 95 to select coefficients of the control filter 70 from the storage device 300, are equipped.

In the sixth embodiment, under conditions that a position and a sound increase ratio of each control point in the first area and the second area are combined, the storage device 300 stores coefficients (previously calculated) of the control filter 70 as a preset control filter table. Briefly, a set of spatial transfer characteristics from the first sound source speaker 10 and the second sound source speaker 20 to each control point in the first area and the second area is previously obtained for different positions of the first area and the second area. By using the set of spatial transfer characteristics and sound increase ratios, for example, coefficients of the control filter 70 are calculated from all combinations of the set of spatial transfer characteristics and the sound increase ratios, and stored into the storage device 300. Moreover, in this case, as to calculation of coefficients of the control filter 70, the same method as the first, second or third embodiments can be used.

Figure 24C:
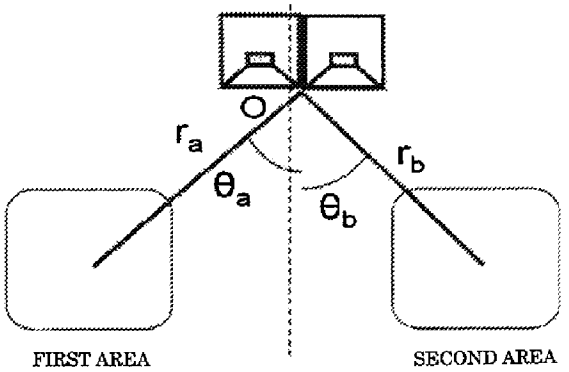
FIGS. 24A-24C are schematic diagrams to explain indication of position of the first area and the second area.
Figure 24A:
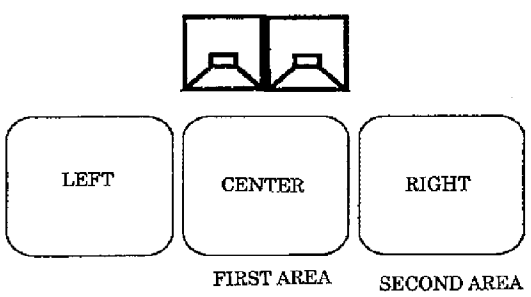
Figure 24B:
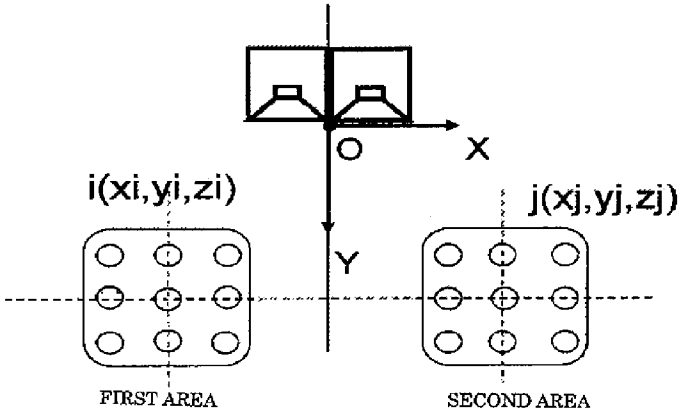

The position supply unit 94 obtains positions of the first area and the second area by a listener via an input device (not shown in FIG. 23), and supplies the positions to the selection unit 95. For example, a position of each control area is defined as a center control point in each control area. In this case, as to a method for indicating the position, as shown in FIG. 24A, direction of left, center, or right, may be roughly indicated. Furthermore, as shown in FIG. 24B, an absolute coordinate centering around the sound field control apparatus may be indicated. Furthermore, as shown in FIG. 24C, a rotary coordinate system centering around the sound field control apparatus may be indicated.

Based on the sound increase ratio (obtained from the second storage unit 50 in FIG. 1) and positions of the first area and the second area (obtained from the position supply unit 94), the selection unit 95 selects coefficients of the control filter 70 corresponding to a combination thereof from the storage device 300. By using a first acoustic signal (obtained from the acoustic signal supply unit 30) and each coefficient selected by the selection unit 95, the control filter 70 convolutes each coefficient (an FIR operation) with the first acoustic signal.

As mentioned-above, in the apparatus and method for controlling a sound field according to at least one of the first, second, third, fourth, fifth and sixth embodiments, when a sound coming from the common sound source is transferred to two areas, sound pressures of the two areas can be respectively controlled.

While certain embodiments have been described, these embodiments have been presented by way of examples only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An apparatus for controlling a sound field, comprising:

a control filter configured to convolute a first filter coefficient and a second filter coefficient with a first acoustic signal to generate a second acoustic signal and a third acoustic signal;

a first speaker to radiate a sound toward a first area having a first control point and a second area having a second control point, based on the second acoustic signal;

a second speaker to radiate a sound toward the first area and the second area, based on the third acoustic signal; and a calculation unit configured to calculate the first filter coefficient and the second filter coefficient by using spatial transfer characteristics from the first speaker and the second speaker to the first control point and the second control point, and a first sound increase ratio na at the first control point and a second sound increase ratio nb at the second control point, so that a first composite sound pressure from the first speaker and the second speaker to the first control point is na times a first sound pressure from the first speaker to the first control point when the first filter coefficient is a through characteristic, and so that a second composite sound pressure from the first speaker and the second speaker to the second control point is nb times a second sound pressure from the first speaker to the second control point when the first filter coefficient is the through characteristic.

2. The apparatus according to claim 1, wherein the calculation unit calculates the first filter coefficient and the second filter coefficient so as to minimize a first acoustic energy of the first area by subtracting na times the first sound pressure from the first composite sound pressure, and so as to minimize a second acoustic energy of the second area by subtracting nb times the second sound pressure from the second composite sound pressure.

3. The apparatus according to claim 1, further comprising:

a volume adjustment unit configured to amplify the second acoustic signal and the third acoustic signal.

4. The apparatus according to claim 1, wherein the first speaker and the second speaker have an allowance amplitude respectively, further comprising:

a detection unit configured to detect whether an amplitude of any of the second acoustic signal and the third acoustic signal is smaller than or equal to the allowance amplitude; and an adjustment unit configured to adjust the amplitude to be smaller than or equal to the allowance amplitude when the amplitude is larger than the allowance amplitude.

5. An apparatus for controlling a sound field, comprising:

a control filter configured to convolute a first filter coefficient and a second filter coefficient with a first acoustic signal to generate a second acoustic signal and a third acoustic signal;

a first speaker to radiate a sound toward a first area having a first control point and a second area having a second control point, based on the second acoustic signal;

a second speaker to radiate a sound toward the first area and the second area, based on the third acoustic signal; and a storage unit configured to store the first filter coefficient and the second filter coefficient calculated by using spatial transfer characteristics from the first speaker and the second speaker to the first control point and the second control point, and a first sound increase ratio na at the first control point and a second sound increase ratio nb at the second control point, so that a first composite sound pressure from the first speaker and the second speaker to the first control point is na times a first sound pressure from the first speaker to the first control point when the first filter coefficient is a through characteristic, and so that a second composite sound pressure from the first speaker and the second speaker to the second control point is nb times a second sound pressure from the first speaker to the second control point when the first filter coefficient is the through characteristic.

6. A method for controlling a sound field in a system including a first speaker and a second speaker, comprising:

convoluting a first filter coefficient and a second filter coefficient with a first acoustic signal to generate a second acoustic signal and a third acoustic signal;

radiating by the first speaker, a sound toward a first area having a first control point and a second area having a second control point, based on the second acoustic signal;

radiating by the second speaker, a sound toward the first area and the second area, based on the third acoustic signal; and calculating the first filter coefficient and the second filter coefficient by using spatial transfer characteristics from the first speaker and the second speaker to the first control point and the second control point, and a first sound increase ratio na at the first control point and a second sound increase ratio nb at the second control point, so that a first composite sound pressure from the first speaker and the second speaker to the first control point is na times a first sound pressure from the first speaker to the first control point when the first filter coefficient is a through characteristic, and so that a second composite sound pressure from the first speaker and the second speaker to the second control point is nb times a second sound pressure from the first speaker to the second control point when the first filter coefficient is the through characteristic.

* * * * *